US010558150B1

(12) United States Patent
Kitajima et al.

(10) Patent No.: US 10,558,150 B1
(45) Date of Patent: Feb. 11, 2020

(54) IMAGE FORMING APPARATUS

(71) Applicant: FUJI XEROX CO., LTD., Tokyo (JP)

(72) Inventors: Katsuyuki Kitajima, Kanagawa (JP); Masataka Kuribayashi, Kanagawa (JP); Takafumi Koide, Kanagawa (JP); Teppei Yawada, Kanagawa (JP); Shota Oshima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/372,416

(22) Filed: Apr. 2, 2019

(30) Foreign Application Priority Data

Aug. 28, 2018 (JP) ..... 2018-159221

(51) Int. Cl.
*G03G 15/20* (2006.01)
*G03G 21/10* (2006.01)
(Continued)

(52) U.S. Cl.
CPC ..... *G03G 15/2017* (2013.01); *G03G 9/0819* (2013.01); *G03G 9/0827* (2013.01);
(Continued)

(58) Field of Classification Search
CPC ..... G03G 15/2017; G03G 21/10; G03G 2215/2003; G03G 9/0819; G03G 9/0827; G03G 9/08755; G03G 9/08782
See application file for complete search history.

(56) References Cited

U.S. PATENT DOCUMENTS

2002/0034409 A1* 3/2002 Furuya ..... G03G 15/2057 399/333
2011/0064450 A1* 3/2011 Ishii ..... G03G 15/2028 399/98
2013/0183061 A1* 7/2013 Park ..... G03G 15/657 399/98

FOREIGN PATENT DOCUMENTS

JP 2015138248 7/2015
JP 2016024428 2/2016
JP 2017015802 1/2017

* cited by examiner

*Primary Examiner* — Gregory H Curran
(74) *Attorney, Agent, or Firm* — JCIPRNET

(57) ABSTRACT

An image forming apparatus includes an image holding member, a charging unit that charges the surface of the image holding member, an electrostatic latent image forming unit that forms an electrostatic latent image on the charged surface of the image holding member, a developing unit that includes a developer containing toner particles containing a release agent having a melting temperature ranging from 60° C. to 100° C. and that develops the electrostatic latent image on the surface of the image holding member with the developer to form a toner image, a transferring unit that transfers the toner image to a recording medium, a fixing unit that includes two members of which the outer surfaces are in contact with each other to form a nipping region and of which at least one member is a belt member and that allows the recording medium having the transferred toner image to pass through the nipping region to fix the toner image to the recording medium, a particle
(Continued)

charging unit that is disposed in the vicinity of the nipping region and upstream of the nipping region in the transport direction of the recording medium so as to face the toner-image-formed side of the recording medium and that charges particles, and a particle collecting unit that is disposed near the particle charging unit and that is charged to the opposite polarity to the charged particles.

14 Claims, 3 Drawing Sheets

(51) Int. Cl.
*G03G 9/087* (2006.01)
*G03G 9/08* (2006.01)

(52) U.S. Cl.
CPC ..... *G03G 9/08755* (2013.01); *G03G 9/08782* (2013.01); *G03G 21/10* (2013.01); *G03G 2215/2003* (2013.01)

IMAGE FORMING APPARATUS

CROSS-REFERENCE TO RELATED APPLICATIONS

This application is based on and claims priority under 35 USC 119 from Japanese Patent Application No. 2018-159221 filed Aug. 28, 2018.

BACKGROUND

(i) Technical Field

The present disclosure relates to an image forming apparatus.

(ii) Related Art

An electrophotographic process for forming an image, for example, includes charging the surface of an image holding member, forming an electrostatic latent image on this surface of the image holding member on the basis of image information, developing the electrostatic latent image with a developer containing toner to form a toner image, and transferring and fixing the toner image to the surface of a recording medium.

Japanese Laid Opened Patent Application Publication No. 2017-15802 discloses an image forming apparatus including an exhaust channel that introduces air discharged from a fixing device to the outside, the fixing device heating toner transferred to a sheet to fix the toner to the sheet; a charging unit that is disposed in the exhaust channel to charge ultra-fine particles in air to a first polarity; a collection unit that is disposed downstream of the charging unit in the direction of the airstream in the exhaust channel and that is charged to a second polarity which is opposite to the first polarity; and a controller that adjusts the absolute value of at least one of the charging voltages of the charging unit and collection unit to be greater in a predetermined first term from the beginning of the operation of the fixing device than in a predetermined second term which is after the first term.

Japanese Laid Opened Patent Application Publication No. 2015-138248 discloses an image forming apparatus including a fixing device that heats toner transferred to a sheet to fix the toner to the sheet, an exhaust mechanism that includes a first channel and second channel which split the stream of air discharged from the fixing device and then join the split airstreams, a particle charging unit that changes ultra-fine particles passing through the first channel to a positive polarity, and a second charging unit that changes ultra-fine particles passing through the second channel to a negative polarity.

Japanese Laid Opened Patent Application Publication No. 2016-24428 discloses an image forming apparatus including an exhaust channel that introduces air discharged from a fixing device to the outside, the fixing device heating toner transferred to a sheet to fix the toner to the sheet; a first charging unit that is disposed in the exhaust channel to charge ultra-fine particles in the air to a first polarity; a first collection unit that is disposed downstream of the first charging unit in the direction of the airstream in the exhaust channel and that is charged to a second polarity which is opposite to the first polarity; a second charging unit that is disposed downstream of the first collection unit in the airstream direction of the exhaust channel to charge the ultra-fine particles in the air to the second polarity; and a second collection unit that is disposed downstream of the second charging unit in the airstream direction of the exhaust channel and that is charged to the first polarity.

An image forming apparatus having a structure that enables fixing at low temperature, for example, includes a fixing unit (also referred to as "belt fixing unit") which includes two rotational members having outer surfaces being opposite to and in contact with each other to form a nipping region, in which one of the two rotational members is a belt member to make the nipping region being long (wide), and in which a recording medium having a transferred toner image is heated and pressed for a longer duration of time by passing through the nipping region to fix the toner image to the recording medium; in such an image forming apparatus, a toner having toner particles containing a release agent with a low melting temperature (such as a melting temperature of 100° C. or less) is used.

In such an image forming apparatus, however, heat is transferred from the belt fixing unit to the recording medium, and temperature therefore tends to be high in a region upstream of the nipping region in the transport direction of the recording medium, and thus the release agent having a low melting temperature is easily evaporated in such a region. The evaporated release agent re-solidifies in air inside the apparatus, which may result in generation of particles having a diameter of 100 nm or less [namely, Ultra-Fine Particles (UFPs)]. These particles having a diameter of 100 nm or less (UFPs) are discharged to the outside of the image forming apparatus in some cases.

SUMMARY

Aspects of non-limiting embodiments of the present disclosure relate to provide an image forming apparatus that includes a belt fixing unit having the above-mentioned structure and that involves use of a toner having toner particles containing a release agent with a melting temperature ranging from 60° C. to 100° C., and this image forming apparatus enables a reduction in the amount of particles having a diameter of 100 nm or less (UFPs) and discharged to the outside of the apparatus as compared with an image forming apparatus that does not have a particle charging unit for charging particles and a particle collecting unit charged to the opposite polarity to the charged particles in the vicinity of the nipping region of the belt fixing unit and upstream of the nipping region in the transport direction of the recording medium.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding member, a charging unit that charges the surface of the image holding member, an electrostatic latent image forming unit that forms an electrostatic latent image on the charged surface of the image holding member, a developing unit that includes a developer containing toner particles containing a release agent having a melting temperature ranging from 60° C. to 100° C. and that develops the electrostatic latent image on the surface of the image holding member with the developer to form a toner image, a transferring unit that transfers the toner image to a recording medium, a fixing unit that includes two members of which the outer surfaces are in contact with each other to form a nipping region and of which at least one member is a belt member and that allows the recording medium having the transferred toner image to pass through the nipping region to fix the toner image to the recording medium, a particle charging unit that is disposed in the vicinity of the nipping region and upstream of the nipping region in the transport direction of the recording medium so as to face the toner-image-formed side of the recording medium and that charges particles, and a particle collecting unit that is disposed near the particle charging unit and that is charged to the opposite polarity to the charged particles.

BRIEF DESCRIPTION OF THE DRAWINGS

Exemplary embodiment of the present disclosure will be described in detail based on the following figures, wherein.

DETAILED DESCRIPTION

Figure 1:
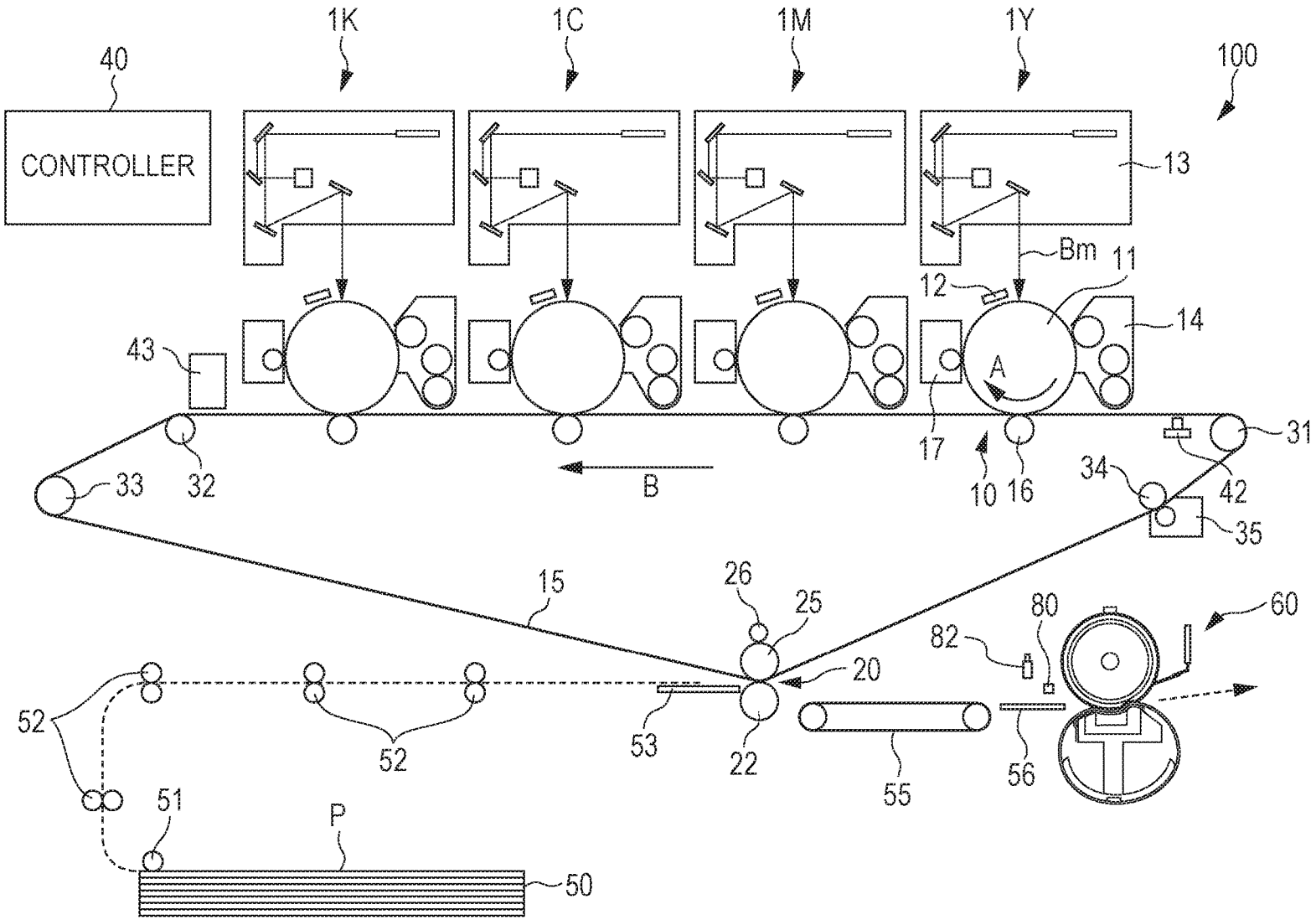
FIG. 1 schematically illustrates an example of the structure of an image forming apparatus according to the exemplary embodiment.

An exemplary embodiment that is an example of the present disclosure will now be described in detail.

Image Forming Apparatus

An image forming apparatus according to the exemplary embodiment includes an image holding member, an image holding member charging unit that charges the surface of the image holding member, an electrostatic latent image forming unit that forms an electrostatic latent image on the charged surface of the image holding member, a developing unit that develops the electrostatic latent image on the surface of the image holding member with a developer containing toner having toner particles containing a release agent with a melting temperature ranging from 60° C. to 100° C. to form a toner image, a transfer unit that transfers the toner image to a recording medium, a fixing unit that includes two rotational members of which the outer surfaces are opposite to and in contact with each other to form a nipping region and of which at least one member is a belt member and that allows the recording medium having a transferred toner image to pass through the nipping region to fix the toner image to the recording medium, a particle charging unit that is disposed in the vicinity of the nipping region and upstream of the nipping region in the transport direction of the recording medium so as to face the toner-image-formed side of the recording medium and that charges particles, and a particle collecting unit that is disposed near the particle charging unit and that is charged to the opposite polarity to the charged particles.

The toner having toner particles containing a release agent with a melting temperature ranging from 60° C. to 100° C. is also referred to as "specific toner" in the following description.

Energy conservation has been demanded in recent years, and a technique for fixing toner at low temperature is therefore used to reduce power consumption in fixing of a toner image.

In order to enhance fixability at low temperature, for example, toner having toner particles containing a release agent having a low melting temperature (such as a release agent having a melting temperature of 100° C. or less) is used in a developer accommodated in a developing unit of some image forming apparatuses. In the case where an image is formed with such a toner containing a release agent having a low melting temperature and where a toner image transferred to a recording medium is fixed with a fixing unit, the release agent contained in the toner image is likely to be vaporized together with moisture contained in the recording medium. The vaporized release agent re-solidifies in air, which results in the generation of particles derived from the evaporated release agent and having a size of 100 nm or less [also referred to as Ultra-Fine Particles (UFPs)]. Such generated particles are discharged to the outside of the image forming apparatus in some cases.

In an image forming apparatus in which an image is fixed with a belt fixing unit, heat is transferred from the belt fixing unit to a recording medium; hence, the temperature tends to be high upstream of the nipping region in the transport direction of the recording medium. Accordingly, the release agent having a low melting temperature is likely to be vaporized upstream of the nipping region of the fixing unit in the transport direction of the recording medium, and thus UFPs derived from the vaporized release agent tend to be easily generated.

The image forming apparatus according to the exemplary embodiment includes the fixing unit including two rotational members of which the outer surfaces are opposite to and in contact with each other to form the nipping region and of which at least one member is a belt member; in addition, the image forming apparatus also includes the particle charging unit that is disposed in the vicinity of the nipping region and upstream of the nipping region in the transport direction of the recording medium so as to face the toner-image-formed side of the recording medium and that charges particles and the particle collecting unit that is disposed near the particle charging unit and that is charged to the opposite polarity to the charged particles.

Since the particle charging unit is disposed at a position at which UFPs are likely to be generated, the UFPs derived from the vaporized release agent are charged. The particle collecting unit is disposed near the particle charging unit and charged to the opposite polarity to the charged particles (UFPs). The UFPs charged by the particle charging unit are attracted by the particle collecting unit charged to the opposite polarity and stick thereto.

As a result, many of the UFPs derived from the release agent are collected by the particle collecting unit, which enables a reduction in the amount of the UFPs that are to be discharged to the outside of the apparatus.

The image forming apparatus having such a structure according to the exemplary embodiment may reduce the amount of the UFPs discharged to the outside of the apparatus, which may bring another benefit that a high-performance filter does not need to be used in an exhaust outlet.

The image forming apparatus according to the exemplary embodiment may be any of the following known image forming apparatuses: a direct transfer type apparatus in which the toner image formed on the surface of the image holding member is directly transferred to a recording medium, an intermediate transfer type apparatus in which the toner image formed on the surface of the image holding member is transferred to the surface of an intermediate transfer body and in which the toner image transferred to the surface of the intermediate transfer body is then transferred to the surface of a recording medium, an apparatus which has a cleaning unit that serves to clean the surface of the image holding member after the transfer of a toner image and before the charging, and an apparatus which has an erasing unit that radiates light to the surface of the image holding member to remove charges after the transfer of the toner image and before charging.

In the intermediate transfer type apparatus, the transfer unit, for example, includes an intermediate transfer body of which a toner image is to be transferred to the surface, a first transfer member which transfers a toner image formed on the surface of the image holding member to the surface of the intermediate transfer body, and a second transfer member which transfers the toner image transferred to the surface of the intermediate transfer body to the surface of a recording medium.

In the structure of the image forming apparatus according to the exemplary embodiment, for instance, the part that at least includes the image holding member may be in the form of a cartridge that is removably attached to the image forming apparatus (process cartridge).

The image forming apparatus according to the exemplary embodiment will now be described with reference to the drawings.

FIG. 1 schematically illustrates an example of the structure of the image forming apparatus according to the exemplary embodiment.

As illustrated in FIG. 1, an image forming apparatus 100 of the exemplary embodiment is, for example, an intermediate transfer type image forming apparatus that is a so-called tandem type. The image forming apparatus 100 includes image forming units 1Y, 1M, 1C, and 1K that individually form toner images of different color components by an electrophotographic technique; first transfer parts 10 that transfers the toner images of different color components formed by the image forming units 1Y, 1M, 1C, and 1K to an intermediate transfer belt 15 in sequence (first transfer); a second transfer part 20 that collectively transfers the toner images transferred onto the intermediate transfer belt 15 to paper P (example of the recording medium) (second transfer); and a fixing device 60 (example of fixing unit) that fixes the images subjected to the second transfer onto the paper P. The image forming apparatus 100 further includes a controller 40 that gives information to each device (part) or receives information from it to control the operation thereof.

A unit having the intermediate transfer belt 15, the first transfer parts 10, and the second transfer part 20 corresponds to an example of the transfer unit.

Each of the image forming units 1Y, 1M, 1C, and 1K of the image forming apparatus 100 has a photoreceptor 11 as an example of the image holding member that carries a toner image formed on the surface thereof, and the photoreceptor 11 rotates in the direction indicated by the arrow A.

In the vicinity of the photoreceptor 11, a charger 12 (example of the image holding member charging unit) that is an example of the charging unit is provided to charge the photoreceptor 11, and a laser exposure unit 13 that is an example of the electrostatic latent image forming unit is provided to write an electrostatic latent image on the photoreceptor 11 (exposure beam is denoted by the sign Bm in the drawing).

Also in the vicinity of the photoreceptor 11, a developing unit 14 that includes toner of a corresponding color component is provided as an example of the developing unit to turn the electrostatic latent image on the photoreceptor 11 into a visible image with the toner, and a first transfer roller 16 is provided to transfer the toner image of a corresponding color component on the photoreceptor 11 to the intermediate transfer belt 15 at the first transfer part 10.

The specific toner is used as toner of at least one of the color components. In the exemplary embodiment, it is suitable that the toner of each of the color components be the specific toner to produce fixability at low temperature.

Furthermore, a photoreceptor cleaner 17 is provided in the vicinity of the photoreceptor 11 to remove residual toner on the photoreceptor 11. The electrophotographic devices of the charger 12, laser exposure unit 13, developing unit 14, first transfer roller 16, and photoreceptor cleaner 17 are provided in sequence in the rotational direction of the photoreceptor 11. The image forming units 1Y, 1M, 1C, and 1K are disposed substantially in line in the order of yellow (Y), magenta (M), cyan (C), and black (K) from the upstream side of the intermediate transfer belt 15.

The intermediate transfer belt 15 is driven and circulates (rotates) by rollers at the intended rate in the direction denoted by the sign B in FIG. 1. Such rollers include a driving roller 31 that is driven by a motor (not illustrated) to rotate the intermediate transfer belt 15, a supporting roller 32 that supports the intermediate transfer belt 15 extending substantially in line along the direction in which the photoreceptors 11 are disposed, a tensile roller 33 that gives the intermediate transfer belt 15 tension and that functions as a correction roller that reduces meandering of the intermediate transfer belt 15, a back roller 25 provided to the second transfer part 20, and a cleaning back roller 34 provided to a cleaning part that scrapes off residual toner on the intermediate transfer belt 15.

The first transfer parts 10 each have a first transfer roller 16 as an opposite member that is disposed so as to face the photoreceptor 11 with the intermediate transfer belt 15 interposed therebetween. The first transfer roller 16 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roll having a volume resistivity ranging from $10^{7.5}$ Ωcm to $10^{8.5}$ Ωcm.

The first transfer roller 16 is disposed so as to be pressed against the photoreceptor 11 with the intermediate transfer belt 15 interposed therebetween, and a voltage (first transfer bias) is applied to the first transfer roller 16 in the polarity opposite to the polarity in which the toner has been charged (herein defined as negative polarity, the same holds true for the following description). Accordingly, toner images on the individual photoreceptors 11 are electrostatically drawn to the intermediate transfer belt 15 in sequence, and a composite toner image is formed on the intermediate transfer belt 15.

The second transfer part 20 has the back roller 25 and a second transfer roller 22 disposed so as to face the toner-image-carrying side of the intermediate transfer belt 15.

The surface of the back roller 25 is formed of a tube of blended rubber of EPDM and NBR in which carbon has been dispersed, and the inside thereof is formed of EPDM rubber. The back roller 25 is formed so as to have a surface resistivity ranging from $10^7$Ω/□ to $10^{10}$Ω/□, and the hardness thereof is adjusted to be, for instance, 70° (measured with ASKER Durometer Type C manufactured by Kobunshi Keiki Co., Ltd., the same holds true for the following description). The back roller 25 is disposed so as to face the back side of the intermediate transfer belt 15 and serves as a counter electrode of the second transfer roller 22, and a power-supplying roller 26 made of metal is provided in contact with the back roller 25 to steadily apply a second transfer bias.

The second transfer roller 22 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roller having a volume resistivity ranging from $10^{7.5}$ Ωcm to $10^{8.5}$ Ωcm.

The second transfer roller 22 is disposed so as to be pressed against the back roller 25 with the intermediate transfer belt 15 interposed therebetween. The second transfer roller 22 is grounded to form a second transfer bias between the back roller 25 and the second transfer roller 22, and thus a toner image is transferred by the second transfer to paper P (example of recording medium) that is to be transported to the second transfer part 20.

An intermediate transfer belt cleaner 35 that removes residual toner and paper dust on the intermediate transfer belt 15 after the second transfer to clean the surface thereof is provided to the intermediate transfer belt 15 downstream of the second transfer part 20 so as to be movable toward and away from the intermediate transfer belt 15.

The intermediate transfer belt 15, the first transfer parts 10 (first transfer rollers 16), and the second transfer part 20 (second transfer roller 22) correspond to an example of the transfer unit.

A reference signal sensor (home position sensor) 42 that generates a reference signal that is the basis for timing formation of images by the image forming units 1Y, 1M, 1C, and 1K is provided upstream of the image forming unit 1Y for yellow. In addition, an image density sensor 43 that adjusts image quality is provided downstream of the image forming unit 1K for black. The reference sensor 42 recognizes a mark provided on the back side of the intermediate transfer belt 15 and then generates a reference signal, and the controller 40 recognizes the reference signal and instructs the image forming units 1Y, 1M, 1C, and 1K to start formation of images.

The image forming apparatus of the exemplary embodiment has a transporting unit for transporting the paper P. The transporting unit includes a paper container 50 in which the paper P is accommodated, a paper feed roller 51 that takes out the paper P gathered in the paper container 50 at a predetermined timing to transport it, transport rollers 52 that transport the paper P taken out by the paper feed roller 51, a transport guide 53 that introduces the paper P transported by the transport rollers 52 to the second transfer part 20, a transport belt 55 that transports the paper P transported after the second transfer by the second transfer roller 22 to the fixing device 60 (example of fixing unit), and a fixing inlet guide 56 that guides the paper P to the fixing device 60.

The controller 40 is a computer that controls the whole apparatus and carries out a variety of operations. In particular, the controller 40 has, for instance, a central processing unit (CPU), a read only memory (ROM) that stores a variety of programs, a random access memory (RAM) used as a working area in execution of the programs, a nonvolatile memory that stores a variety of information, and input and output interfaces (I/O) (each not illustrated). The CPU, ROM, RAM, nonvolatile memory, and I/O are connected to each other via buses.

The image forming apparatus 100 has, in addition to the controller 40, an operation-displaying part, an image-processing part, an image memory, a storage part, and a communication part (each not illustrated). The operation-displaying part, the image-processing part, the image memory, the storage part, and the communication part are each connected to the I/O of the controller 40. The controller 40 exchanges information with the operation-displaying part, the image-processing part, the image memory, the storage part, and the communication part to control each part. The controller 40 also controls a preset fixing temperature that will be described later.

The image forming apparatus 100 includes the fixing device 60 (example of the fixing unit) including a heating belt and a pressure roller (example of the two rotational members), and the outer surfaces of the heating belt and pressure roller are opposite to and in contact with each other to form a nipping region (namely, nip part).

The image forming apparatus 100 also includes a charger 80 (example of the particle charging unit) that charges particles and a particle collecting device 82 (example of the particle collecting unit) that is charged to the opposite polarity to the charged particles, and the charger 80 and the particle collecting device 82 are disposed in the vicinity of the nipping region of the fixing device 60 and upstream of the nipping region in the transport direction of the paper P.

The fixing unit, the particle charging unit, and the particle collecting unit will be described later in detail.

A basic process for forming an image in the image forming apparatus of the exemplary embodiment will now be described.

In the image forming apparatus of the exemplary embodiment, image data output from, for example, an image reader or personal computer (PC) (each not illustrated) is subjected to image processing with an image processor (not illustrated); and then the image forming units 1Y, 1M, 1C, and 1K perform an imaging operation.

The image processor performs image processing including shading compensation, misregistration correction, brightness/color space conversion, gamma correction, and a variety of image editing such as frame elimination, a color edit, and a moving edit on the basis of input data of reflectance. The image data subjected to the image processing is converted to colorant tone data of four colors of Y, M, C, and K and output to the laser exposure unit 13.

In the laser exposure unit 13, an exposure beam Bm emitted from, for example, a semiconductor laser is radiated to the photoreceptor 11 of each of the image forming units 1Y, 1M, 1C, and 1K on the basis of the input colorant tone data. The surfaces of the photoreceptors 11 of the image forming units 1Y, 1M, 1C, and 1K are charged with the charger 12; and the charged surfaces are subjected to scanning exposure with the laser exposure unit 13 to form electrostatic latent images. The formed electrostatic latent images are developed by the image forming units 1Y, 1M, 1C, and 1K into toner images of Y, M, C, and K, respectively.

The toner images formed on the photoreceptors 11 of the image forming units 1Y, 1M, 1C, and 1K are transferred to the intermediate transfer belt 15 at the first transfer parts 10 in which the individual photoreceptors 11 contact with the intermediate transfer belt 15. More specifically, the first transfer is carried out in the first transfer parts 10 as follows: the first transfer rollers 16 apply voltage (first transfer bias) to the substrate of the intermediate transfer belt 15 in the polarity opposite to the polarity in which toner has been charged (negative polarity), and the toner images are placed one upon another on the surface of the intermediate transfer belt 15 in sequence.

After the toner images are sequentially subjected to the first transfer to the surface of the intermediate transfer belt 15, the intermediate transfer belt 15 moves to transport the toner images to the second transfer part 20. The transportation of the toner images to the second transfer part 20 causes the paper feed roller 51 in the transporting unit to rotate on the basis of the timing of the transportation of the toner images to the second transfer part 20, and paper P with the intended size is supplied from the paper container 50. The paper P supplied by the paper feed roller 51 is transported by the transport rollers 52 and then reaches the second transfer part 20 through the transport guide 53. Before the paper P reaches the second transfer part 20, the paper P is stopped, an alignment roller (not illustrated) rotates on the basis of the timing of the movement of the intermediate transfer belt 15 carrying the toner images to align the position of the paper P with the position of the toner images.

In the second transfer part 20, the second transfer roller 22 is pressed against the back roller 25 with the intermediate transfer belt 15 interposed therebetween. The paper P transported at the right timing enters between the intermediate transfer belt 15 and the second transfer roller 22. At this time, the power supplying roller 26 applies voltage (second transfer bias) in the polarity the same as the polarity in which toner has been charged (negative polarity), and then a transfer electric field is formed between the second transfer roller 22 and the back roller 25. The unfixed toner images carried by the intermediate transfer belt 15 is electrostatically transferred onto the paper P at one time at the second transfer part 20 at which the second transfer roller 22 and the back roller 25 are pressed against each other.

Then, the paper P having the electrostatically transferred toner images is transported by the second transfer roller 22 in a state in which it is separated from the intermediate transfer belt 15 and reaches the transport belt 55 provided upstream of the second transfer roller 22 in the transport direction of the paper P. The transport belt 55 transports the paper P to the fixing device 60 at the optimum transport rate for the fixing device 60.

UFPs generated upstream of the nipping region of the fixing device 60 in the transport direction of the paper P are charged by the charger 80 that charges particles and then collected by the particle collecting device 82 charged to the opposite polarity to the charged particles.

The unfixed toner images on the paper P transported to the fixing device 60 are fixed onto the paper P through being heated and pressed by the fixing device 60.

The paper P having the fixed image is transported to an ejected paper holder (not illustrated) provided to an ejection part of the image forming apparatus.

In the image forming apparatus according to the exemplary embodiment, UFPs generated upstream of the nipping region of the fixing device 60 in the transport direction of the paper P are collected by the particle collecting device 82. As a result, the amount of the UFPs that are generated upstream of the nipping region of the fixing device 60 in the transport direction of the paper P and that are to be discharged to the outside of the apparatus is reduced.

After the transfer to the paper P is finished, residual toner on the intermediate transfer belt 15 is transported to the cleaning part by the rotation of the intermediate transfer belt 15 and then removed from the intermediate transfer belt 15 with the cleaning back roller 34 and the intermediate transfer belt cleaner 35.

Fixing Unit, Particle Charging Unit, and Particle Collecting Unit

The fixing unit, particle charging unit, and particle collecting unit used in the image forming apparatus according to the exemplary embodiment will be described in detail.

The fixing unit includes two rotational members of which the outer surfaces are opposite to and in contact with each other to form a nipping region and of which at least one member is a belt member; in the fixing unit, a recording medium having a transferred toner image passes through the nipping region to fix the toner image to the recording medium.

The particle charging unit is disposed in the vicinity of the nipping region of the fixing unit and upstream of the nipping region in the transport direction of the recording medium so as to face the toner-image-formed side of the recording medium and charges particles.

The second charging unit is disposed near the particle charging unit and charged to the opposite polarity to the particles.

The particle charging unit does not only affect UFPs derived from the release agent but also may charge airborne particles other than the UFPs derived from the release agent.

First Example of Fixing Unit, Particle Charging Unit, and Particle Collecting Unit A first example of the fixing unit, particle charging unit, and particle collecting unit will be described with reference to FIG. 2.

Figure 2:
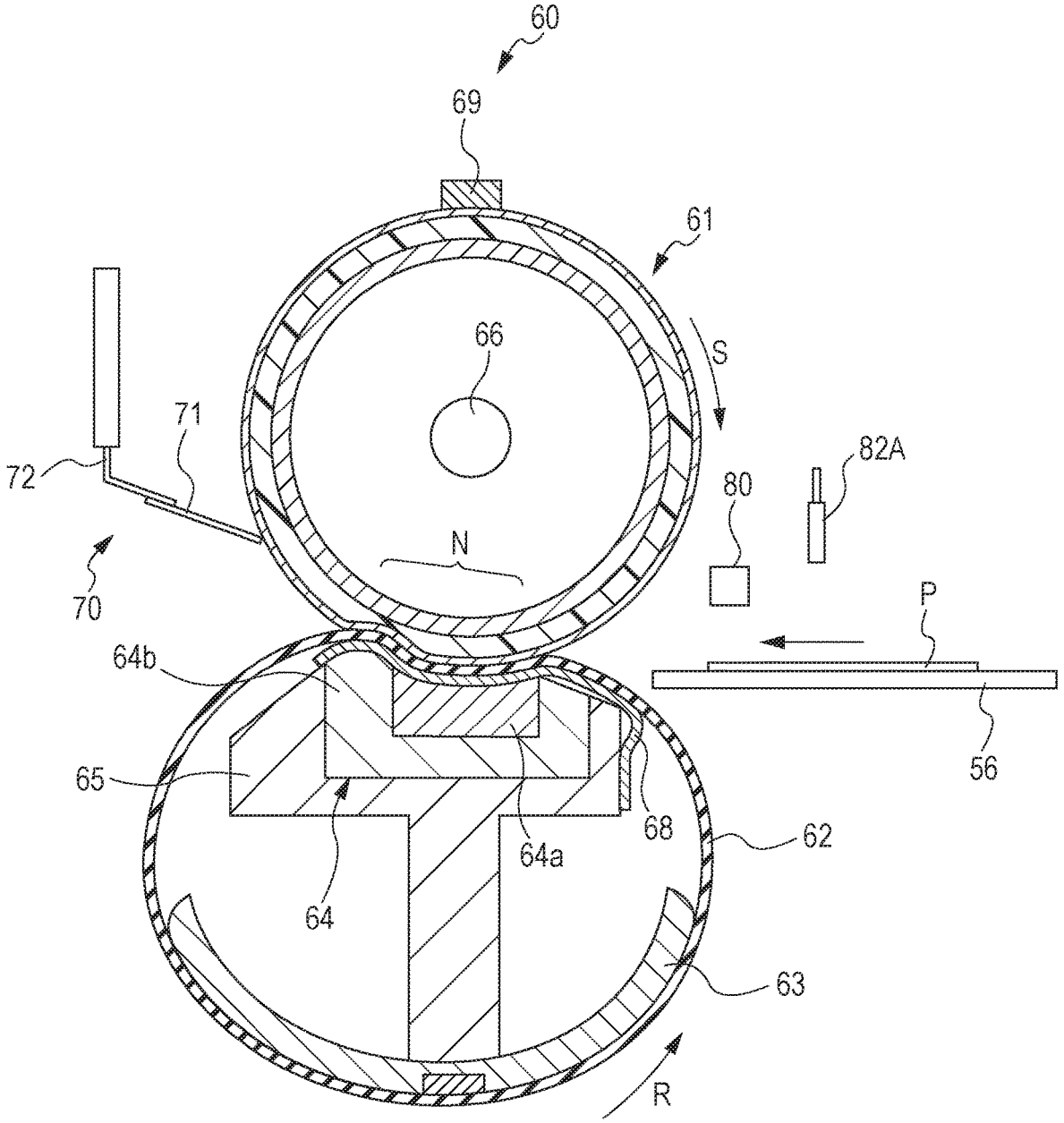
FIG. 2 is a cross-sectional view schematically illustrating an example of a fixing device, charger, and particle collecting device used in the image forming apparatus according to the exemplary embodiment.

FIG. 2 is a cross-sectional view schematically illustrating an example of the fixing device, charger, and particle collecting device used in the image forming apparatus according to the exemplary embodiment.

In the first example and a second example, members having substantially the same functions are denoted by the same reference signs, and description thereof is omitted.

In the fixing device 60 of the first example, the two rotational members are a heating roller 61 having an internal heating unit and a pressure belt 62 as illustrated in FIG. 2.

As illustrated in FIG. 2, the fixing device 60 of the first example, for example, includes the heating roller 61 that is rotationally driven, the pressure belt 62, and a pressing pad 64 that presses the heating roller 61 with the pressure belt 62 interposed therebetween.

The pressing pad 64 is merely an example of the pressing member; for instance, it may be in another form provided that the pressure belt 62 and the heating roller 61 are relatively pressed. Accordingly, the pressure belt 62 may be pressed against the heating roller 61, or the heating roller 61 may be pressed against the pressure belt 62.

The heating roller 61 has a halogen lamp 66 (example of the heating unit) provided inside. The heating unit is not limited to the halogen lamp and may be another heating element that emits heat.

A thermo-sensor 69 is, for instance, provided in contact with the surface of the heating roller 61. The heating by the halogen lamp 66 is controlled on the basis of the temperature measured by the thermo-sensor 69, and the surface temperature of the heating roller 61 is maintained at the intended preset fixing temperature (for example, 150° C.)

The preset fixing temperature of the heating roller 61 is preferably from 100° C. to 200° C., and more preferably from 120° C. to 200° C. in terms of the fixability of the toner at low temperature.

The pressure belt 62 is, for example, rotatably supported by the pressing pad 64 and belt running guide 63 that are each provided inside the pressure belt 62. The pressure belt 62 is disposed so as to be pressed against the heating roller 61 by the pressing pad 64 in the nipping region N (nip part)

The pressing pad 64 is, for instance, disposed so as to be pushed by the heating roller 61 inside the pressure belt 62 with the pressure belt 62 interposed therebetween, so that the nipping region N is formed between the pressing pad 64 and the heating roller 61.

The pressing pad 64, for example, has a front pinching member 64*a* that is provided on the entrance side of the nipping region N to make the nipping region N being wide and a separation pinching member 64*b* that is provided on the exit side of the nipping region N to distort the heating roller 61.

In order to reduce the sliding resistance between the inner surface of the pressure belt 62 and the pressing pad 64, a sheet-like sliding member 68 is, for instance, provided on the pressure-belt-62-side surfaces of the front pinching member 64*a* and separation pinching member 64*b*. The pressing pad 64 and the sliding member 68 are held by a metal holding member 65.

The sliding member 68 is, for example, disposed such that the sliding side thereof is in contact with the inner surface of the pressure belt 62. The sliding member 68 serves for retention and supply of oil existing between the sliding member 68 and the pressure belt 62.

The holding member 65 is, for instance, attached to the belt running guide 63, and this structure enables the pressure belt 62 to rotate.

The heating roller 61 is, for example, rotated by a driving motor (not illustrated) in the direction denoted by the arrow S, and this rotation of the heating roller 61 forces the pressure belt 62 to rotate in the direction denoted by the arrow R, which is opposite to the rotational direction of the heating roller 61. In other words, for instance, the heating roller 61 rotates clockwise in FIG. 2, while the pressure belt 62 rotates counterclockwise.

The paper P having an unfixed toner image is, for instance, introduced to the nipping region N by a fixing entrance guide 56. When the paper P passes through the nipping region N, the toner image on the paper P is fixed by pressure and heat that affect the nipping region N.

In the fixing device 60, for example, the front pinching member 64*a* having a recess that reflects the profile of the outer surface of the heating roller 61 enables the nipping region N to be wide as compared with the case where the front pinching member 64*a* is not provided.

Furthermore, in the fixing device 60, for example, the separation pinching member 64*b* is disposed so as to protrude toward the outer surface of the heating roller 61, so that the distortion of the heating roller 61 is locally large at the exit part of the nipping region N.

Such a structure of the separation pinching member 64*b*, for instance, enables the paper P having a fixed image to pass through the locally large distortion when it passes through the region of the separation pinching member 64*b*; thus, the paper P is easily separated from the heating roller 61.

A separation member 70 is, for example, provided to the heating roller 61 downstream of the nipping region N as an aid for the separation of the paper P. The separation member 70, for instance, includes a separation nail 71 and a holding member 72, and the holding member 72 holds the separation nail 71 such that the separation nail 71 faces the direction opposite to the rotational direction of the heating roller 61 (counter direction) in a state in which the separation nail 71 is near the heating roller 61.

In the fixing device 60, the charger 80 and the particle collecting device 82A charged to the opposite polarity to the particles are provided in the vicinity of the nipping region N and upstream of the nipping region N in the transport direction of the paper P.

As illustrated in FIG. 2, the charger 80 and the particle collecting device 82A are each disposed so as to face the toner image side of the paper P (toner-image-formed side).

The charger 80 may be any charging device provided that it can charge airborne particles (including UFPs), and examples thereof include corona discharge devices and plasma discharge devices.

In particular, corona discharge devices are suitable because they are easily available and have a simple structure.

The charging type may be either a direct current (DC) charging type or an alternate current (AC) charging type. A DC charging type is suitable because it is more secure.

The polarity to which the charger 80 charges particles is suitably the same as the polarity of the toner in order to reduce an effect on toner particles before the fixing process (specifically, for instance, in order to reduce distortion of an unfixed toner image due to the scattering of tone particles).

The position and number of the charger 80 may be determined on the basis of the shape, size, and another structure of the charging device that is to be used.

In the case where the charger 80 is a long charging device, for example, a single charging device may be used and disposed such that the longitudinal direction thereof is along the direction vertical to the transport direction of the recording medium (namely, the axial direction of the heating roller 61 and pressure belt 62).

In the case where the charger 80 is a short charging device, multiple charging devices may be used and disposed at intervals along the direction vertical to the transport direction of the recording medium (namely, the axial direction of the heating roller 61 and pressure belt 62).

The charger 80 is disposed in the vicinity of the nipping region N and upstream of the nipping region N in the transport direction of the paper P, and this means that the position of the charger 80 is within a such a distance from the upstream end of the nipping region N in the transport direction of the paper P that particles including UFPs can be efficiently charged.

Specifically, the minimum distance from the upstream end of the nipping region in the transport direction to the charger 80 is suitably from 30 mm to 70 mm.

The minimum distance from the transport path of the paper P to the charger 80 is suitably from 10 mm to 40 mm in order to efficiently charge particles including UFPs and to reduce an effect on an unfixed toner image.

The minimum distance from the outer surface of the heating roller 61 to the charger 80 is suitably from 15 mm to 50 mm in order to efficiently charge particles including UFPs.

The transport path in the exemplary embodiment refers to a path through which the lower side of the recording medium (namely, side opposite to the side having a toner image that is to be fixed by the fixing unit) passes in the transportation of the recording medium (paper P).

The particle collecting device 82A is not particularly limited provided that at least part thereof can be charged to the opposite polarity to the particles charged by the charger 80. Examples of the particle collecting device 82A include electrodes and charging members using metal materials or semiconductor materials such as graphite and silicon carbide.

In particular, electrodes are suitable because they are easily available and inexpensive.

The charging type of the particle collecting device 82A may be either a DC charging type or an AC charging type. A DC charging type is suitable because it is more secure.

The position and number of the particle collecting device 82A may be determined on the basis of the shape, size, and another structure of the charger (particle charging unit) that is to be used.

In the case where the particle collecting device 82A is a long charging device, for example, a single charging device may be used and disposed such that the longitudinal direction thereof is along the direction vertical to the transport direction of the recording medium (namely, the axial direction of the heating roller 61 and pressure belt 62).

In the case where the particle collecting device 82A is a short charging device, multiple charging devices may be used and disposed at intervals along the direction vertical to the transport direction of the recording medium (namely, the axial direction of the heating roller 61 and pressure belt 62).

The particle collecting device 82A is disposed near the charger 80.

Specifically, the minimum distance from the charger 80 to the particle collecting device 82A is suitably approximately 10 mm in order to enhance the efficiency in collecting particles.

The particle collecting device 82A is disposed above the charger 80 (above in the gravity direction) in order to enhance the efficiency in collecting particles.

The charging type of the particle collecting device 82A may be either a DC charging type or an AC charging type. A DC charging type is suitable because it is more secure.

Second Example of Fixing Unit, Particle Charging Unit, and Particle Collecting Unit A second example of the fixing unit, particle charging unit, and particle collecting unit will be described with reference to FIG. 3.

Figure 3:
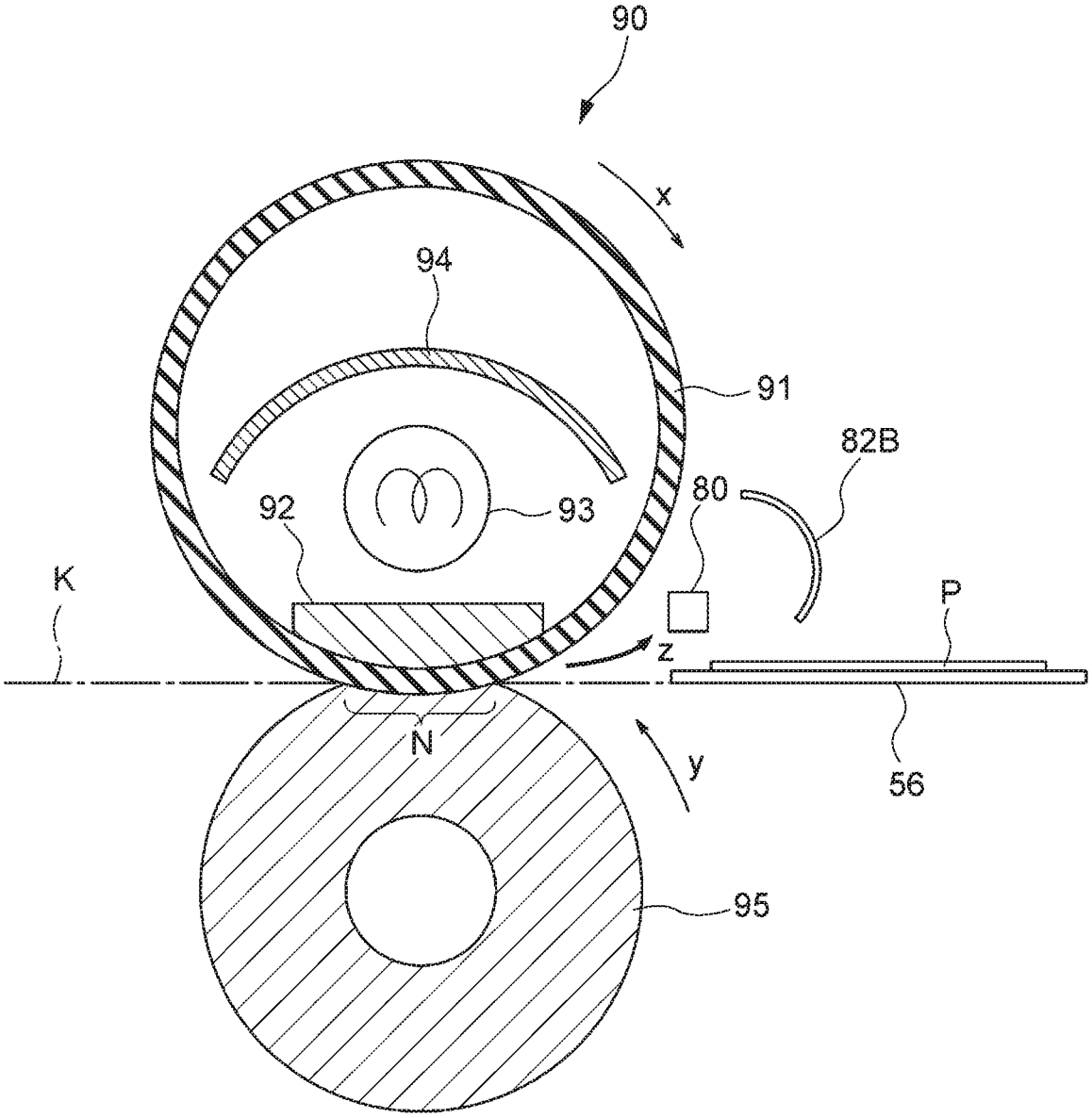
FIG. 3 is a cross-sectional view schematically illustrating another example of the fixing device, charger, and particle collecting device used in the image forming apparatus according to the exemplary embodiment.

FIG. 3 is a cross-sectional view schematically illustrating another example of the fixing device, charger, and particle collecting device used in the image forming apparatus according to the exemplary embodiment.

In a fixing device 90 of the second example, the two rotational members are a heating belt 91 having an internal heating unit and pressure roller 95 as illustrated in FIG. 3.

As illustrated in FIG. 3, the fixing device 90 includes the heating belt 91, the pressure roller 95 (example of the rotational member), a pressure pad 92 (example of the pressure member), a halogen lamp 93 (example of the heat source), and a reflection plate 94.

The outer surfaces of the heating belt 91 and pressure roller 95 are in contact with each other to form the nipping region N. The heating belt 91 and the pressure roller 95 rotate together (in the directions denoted by the arrows x and y, respectively) to transport the paper P in the nipping region N.

The heating belt 91 is a belt that contacts a toner image transferred to the surface of the paper P. An example of the heating belt 91 is an endless belt having a substrate (for example, substrate formed of polyimide resin), an elastic layer (for instance, silicone rubber layer) on the substrate, and a release layer (for example, fluororesin layer) on the elastic layer.

The thickness of the heating belt 91 is, for instance, from 110 μm to 450 μm (suitably from 110 μm to 430 μm) in terms of a reduction in heat capacity.

The heating belt 91 is rotatably supported by bearings (not illustrated) at the two ends in the axial direction. One end of the heating belt 91 in the axial direction is engaged with a drive transmission member (such as gear, not illustrated). The drive transmission member is rotated around the axis by a drive source (such as motor, not illustrated) to rotate the heating belt 91.

The pressure roller 95 is provided in contact with the outer surface of the heating belt 91.

The pressure roller 95 is, for example, formed of resin or metal so as to have a cylindrical or columnar shape. Part of the outer surface of the pressure roller 95 is pressed against the pressure pad 92 by an action of an elastic member (such as spring) on a bearing (not illustrated) with the heating belt 91 interposed therebetween. This structure allows the pressure roller 95 and the heating belt 91 to form the nipping region N (namely, nip part). In particular, the pressure roller 95 and the pressure pad 92 serve to pinch the heating belt 91 (namely, paper P and toner image) to apply pressure thereto in the nipping region N.

Insertion members (such as caps, not illustrated) are attached to the two ends of the pressure roller 95 in the axial direction to enhance rigidity against external force in the direction of the diameter of the pressure roller 95. The insertion members are rotatable around the axis owing to bearings (not illustrated). The rotation of the heating belt 91 drives and rotates the pressure roller 95. This structure enables the pressure roller 95 to rotate together with the heating belt 91 in the nipping region N to transport the paper P.

Another structure in which rotational driving of the pressure roller 95 drives and rotates the heating belt 91 may be employed.

The pressure pad 92 is provided so as to face the inner surface of the heating belt 91.

An example of the pressure pad 92 is a columnar member formed of resin or metal.

The pressure roller 95 is pressed against the pressure pad 92 with the heating belt 91 interposed therebetween, and thus the pressure pad 92 and the pressure roller 95 pinch the heating belt 91 (namely, paper P and toner image) to apply pressure thereto in the nipping region N.

Another structure in which the pressure pad 92 is pressed toward the pressure roller 95 with an elastic member (such as spring) with the heating belt 91 interposed therebetween may be employed. In other words, the pressure pad 92 may be either a member against which the pressure roller 95 is pressed to apply pressure to the heating belt 91 or a member that is pushed against the pressure roller 95 to apply pressure to the heating belt 91.

A pressure member in the form of a roll may be provided in place of the pressure pad 92.

The halogen lamp 93 is provided so as to face the inner surface of the heating belt 91. Specifically, the halogen lamp 93 is, for example, disposed so as to face the nipping region N with the pressure pad 92 interposed therebetween. The halogen lamp 93 directly heats the nipping region N.

The halogen lamp 93 is in the form of a circular tube extending in the width direction of the heating belt 91 (direction of rotational axis of belt). The halogen lamp 93 has a source of heat that is a filament with small heat capacity and therefore starts radiating heat immediately after the power is turned on.

Any of known heaters such as a ceramic heater and a quartz lamp may be used in place of the halogen lamp 93.

The reflection plate 94 is provided so as to face the inner surface of the heating belt 91. Specifically, the reflection plate 94 is, for example, disposed so as to face the nipping region N with the halogen lamp 93 interposed therebetween.

The reflection plate 94 is, for instance, formed of a planar metal member or a planar resin member having a metal layer formed on the reflection side by vapor deposition. The reflection plate 94 is, for instance, curved so that the nipping region N side thereof is recessed.

The reflection plate 94 functions to reflect radiant heat from the halogen lamp 93 toward the nipping region N.

In the fixing device 90, a toner image formed on the paper P is pressed and heated in the nipping region N in which the heating belt 91 is in contact with the pressure roller 95, so that the toner image is fixed to the paper P. The heating belt 91 has a small heat capacity, and the halogen lamp 93 directly heats the nipping region N; hence, part of the heating belt 91 other than the nipping region N can be easily cooled. Thus, the occurrence of hot offset due to a phenomenon in which the fixing temperature exceeds a predetermined temperature (namely, overshoot) is readily reduced.

The halogen lamp 93 has a source of heat that is a filament with small heat capacity and is therefore a heat source that starts radiating heat immediately after the power is turned on. Use of the halogen lamp 93 therefore enables the power-off mode to be prolonged, which readily reduces the occurrence of hot offset due to overshoot.

Use of the reflection plate 94 enables the nipping region N to be quickly heated. In particular, use of the reflection plate 94 enables the power-off mode of the halogen lamp 93 to be prolonged, which readily reduces the occurrence of hot offset due to overshoot.

In the fixing device 90 of the second example, although the halogen lamp 93 is used, the heating belt 91 may be heated by another heat source. The halogen lamp 93, for example, may be replaced with another heat source (such as a ceramic heater) disposed on part of the pressure pad 92 at which the pressure pad 92 is in contact with the inner surface of the heating belt 91 in order to promptly heat the nipping region N, so that the heating belt 91 is directly heated.

The preset fixing temperature of the heating belt 91 in the fixing device 90 is preferably from 100° C. to 200° C., and more preferably from 120° C. to 200° C. in terms of the fixability of the toner at low temperature.

As illustrated in FIG. 3, the charger 80 and a particle collecting device 82B are disposed in the vicinity of the nipping region N of the fixing device 90 and upstream of the nipping region N in the transport direction of the paper P as in the first example illustrated in FIG. 2.

In the second example illustrated in FIG. 3, the particle collecting device 82B has an arc-like cross-sectional shape.

In the fixing device 90, an airstream is generated by the rotation of the heating belt 91 in the vicinity of the nipping region N and upstream of the nipping region N in the transport direction of the paper P, and this airstream collides with the nipping region N and is heated, which results in generation of another airstream flowing in the direction opposite to the rotational direction of the heating belt 91 (for instance, direction denoted by the arrow z in FIG. 3). UFPs generated upstream of the nipping region N in the transport direction of the paper P are therefore diffused by the airstream flowing in the direction denoted by the arrow z in FIG. 3. Hence, the charger 80 is disposed so as to intervene in the flow of the airstream in the direction denoted by the arrow z, and the particle collecting device 82B is disposed downstream of the charger 80 in the direction denoted by the arrow z. This structure reduces the diffusion of the UFPs and is likely to enhance efficiency in charging and collecting the UFPs. In particular, the arc-like cross-sectional shape of the particle collecting device 82B is further likely to enhance efficiency in charging and collecting the UFPs.

Accordingly, such a structure of the second example is likely to further reduce the amount of UFPs discharged to the outside of the apparatus.

The particle collecting device 82B is suitably a long planar member and disposed such that the longitudinal direction of the planar member is along the direction vertical to the transport direction of the recording medium (namely, the axial direction of the heating belt 91 and pressure roller 95) in terms of efficiency in collecting particles.

Examples of the particle collecting device 82B include electrodes and charging members using metal materials or semiconductor materials such as graphite and silicon carbide.

The particle collecting device 82B has an arc-like cross-sectional shape as illustrated in FIG. 3 to enhance efficiency in collecting particles including UFPs; however, the structure of the particle collecting, device 82B is not limited thereto.

For instance, since efficiency in collecting particles including UFPs can be enhanced by generating an airstream that flows from the upstream end of the nipping region N in the transport direction of paper to the charger and the particle collecting device, a current plate that can generate such an airstream may be provided.

The current plate is suitably a long planar member and disposed such that the longitudinal direction of the planar member is along the direction vertical to the transport direction of the recording medium (namely, the axial direction of the heating belt 91 and the pressure roller 95) because this structure easily enables formation of the airstream flowing to the charger and the particle collecting device.

The material of the current plate is not particularly limited and may be, for example, resin, metal, or ceramic.

Although the first example and the second example have been described, the fixing unit, the particle charging unit, and the particle collecting unit are not limited thereto; for instance, the fixing unit of the first example may be combined with the particle charging unit and particle collecting unit of the second example, and the fixing unit of the second example may be combined with the particle charging unit and particle collecting unit of the first example.

Developer

The toner used in the developer accommodated in the developing unit of the image forming apparatus according to the exemplary embodiment will now be described in detail.

The detail of the toner used in the exemplary embodiment will now be described.

The toner used in the exemplary embodiment contains toner particles and optionally an external additive.

Toner Particles

The toner particles, for example, contain a binder resin, a release agent, and optionally a colorant and another additive.

Release Agent

The melting temperature of the release agent is from 60° C. to 100° C., preferably from 60° C. to 90° C., and more preferably from 60° C. to 75° C.

The melting temperature of the release agent at 100° C. or less enables an enhancement in the fixability of the toner at low temperature, so that the fixing temperature in the image forming apparatus can be lowered. At 100° C. or less of the melting temperature of the release agent, the release agent is likely to be vaporized in the fixing of the toner, and the vaporized release agent re-solidifies in air, which easily results in the generation of the UFPs. Even in this case, however, the amount of the UFPs discharged to the outside of the image forming apparatus is reduced according to the exemplary embodiment.

The melting temperature of the release agent at 60° C. or more reduces the adhesion of the release agent to the fixing member due to the unnecessary melting of the release agent in the fixing of the toner. In addition, such a melting temperature can reduce the excessive generation of the UFPs.

The melting temperature of the release agent can be controlled by any of known techniques, such as changing the type of release agent.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

Examples of the release agent include, but are not limited to, mineral or petroleum waxes such as a montan wax, an ozokerite wax, a ceresin wax, a paraffin wax, a micro crystalline wax, and a Fischer-Tropsch wax; hydrocarbon waxes such as a polyethylene wax, a polypropylene wax, and a polybutene wax; a silicone wax; fatty acid amide waxes such as an oleamide wax, an erucamide wax, a ricinoleamide wax, and a stearamide wax; botanical waxes such as a carnauba wax, a rice bran wax, a candelilla wax, a Japan wax, and a jojoba oil; animal waxes such as beeswax; ester waxes such as a fatty acid ester, a montanic acid ester, and a carboxylic acid ester; and modified products thereof.

Among these, a paraffin wax, a ceresin wax, a carnauba wax, a fatty acid ester, and a montanic acid ester are preferred in terms of the fixability of the toner at low temperature; and a paraffin wax is more preferred.

The release agents may be used alone or in combination. In the case where two or more release agents are used, it is suitable that at least one of the release agents have a melting temperature being in the above-mentioned range, and it is more suitable that all of them have a melting temperature being in the above-mentioned range.

The amount of the release agent is, for example, preferably from 1 mass % to 20 mass %, and more preferably from 5 mass % to 15 mass % relative to the amount of the whole toner particles.

Melting Temperature of Release Agent and Preset Fixing Temperature

The difference between the melting temperature (T2) of the release agent and the preset fixing temperature (T1) of the fixing member of the image forming apparatus (namely, at least one rotational member of the two rotational members) (T1−T2) is preferably from 30° C. to 140° C., more preferably from 40° C. to 120° C., and further preferably from 50° C. to 100° C.

When the preset fixing temperature (T1) is higher than the melting temperature (T2) of the release agent and the difference therebetween (T1−T2) is 140° C. or less, the fixing temperature in the image forming apparatus can be lowered. When the temperature difference (T1−T2) is 30° C. or higher, the adhesion of the toner to the fixing member can be reduced in the fixing of the toner. At the temperature difference (T1−T2) of 30° C. or higher, however, the release agent is likely to be vaporized in the fixing of the toner, and the vaporized release agent re-solidifies in air, which easily results in the generation of the UFPs. Even so, the amount of the UFPs discharged to the outside of the apparatus is reduced according to the exemplary embodiment.

The term "preset fixing temperature" of the fixing member refers to a desired temperature of part of the surface, which comes into contact with an unfixed toner image, of the fixing member. In other words, it is a desired surface temperature of the fixing member (namely, heated rotational member such as the heating roller) at the moment of the contact with an unfixed toner image in such a state that the unfixed toner image has not received the heat.

Binder Resin

Examples of the binder resin include vinyl resins that are homopolymers of monomers such as styrenes (such as styrene, p-chlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene) or copolymers of two or more of these monomers.

Other examples of the binder resin include non-vinyl resins such as epoxy resins, polyester resins, polyurethane resins, polyamide resins, cellulose resins, polyether resins, and modified rosin; mixtures thereof with the above-mentioned vinyl resins; and graft polymers obtained by polymerization of a vinyl monomer in the coexistence of such non-vinyl resins.

These binder resins may be used alone or in combination.

The binder resin suitably contains a crystalline resin in order to enhance the fixability of the toner at low temperature.

The binder resin is suitably a polyester resin. In particular, the binder resin is suitably crystalline polyester.

Examples of the polyester resin include known amorphous polyester resins. The polyester resin may be a combination of the amorphous polyester resin and a crystalline polyester resin.

The "crystallinity" of a resin refers to that the resin does not have a stepwise change in the amount of heat absorption but have a definite endothermic peak in the differential scanning calorimetry (DSC). Specifically, it refers to that the half-value width of the endothermic peak in the measurement at a rate of temperature increase of 10 (° C./min) is within 10° C.

The "amorphous properties" of a resin refers to that the half-value width of the endothermic peak exceeds 10° C., that a stepwise change in the amount of heat absorption is exhibited, or that definite endothermic peak is not observed.

Amorphous Polyester Resin

Examples of the amorphous polyester resin include polycondensates of a polycarboxylic acid with a polyhydric alcohol. The amorphous polyester resin may be a commercially available product or may be a synthesized resin.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid); alicyclic dicarboxylic acids (such as cyclohexanedicarboxylic acid); aromatic dicarboxylic acids (such as terephthalic acid, isophthalic acid, phthalic acid, and naphthalenedicarboxylic acid); anhydrides of the foregoing; and lower alkyl esters (having, for example, from 1 to 5 carbon atoms) of the foregoing. Of these, for example, aromatic dicarboxylic acids are suitable as the polycarboxylic acid.

The polycarboxylic acid may be a combination of the dicarboxylic acid with a carboxylic acid that has three or more carboxy groups and that gives a cross-linked structure or a branched structure. Examples of the carboxylic acid having three or more carboxy groups include trimellitic acid and pyromellitic acid, anhydrides of the foregoing, and lower alkyl esters (having, for example, from 1 to 5 carbon atoms) of the foregoing.

Such polycarboxylic acids may be used alone or in combination.

Examples of the polyhydric alcohol include aliphatic diols (such as ethylene glycol, diethylene glycol, triethylene glycol, propylene glycol, butanediol, hexanediol, and neopentyl glycol); alicyclic diols (such as cyclohexanediol, cyclohexanedimethanol, and hydrogenated bisphenol A); and aromatic diols (such as ethylene oxide adducts of bisphenol A and propylene oxide adducts of bisphenol A). Among these, for example, aromatic diols and alicyclic diols are preferred as the polyhydric alcohol, and aromatic diols are more preferred.

The polyhydric alcohol may be a combination of the diol with a polyhydric alcohol that has three or more hydroxy groups and that gives a cross-linked structure or a branched structure. Examples of the polyhydric alcohol having three or more hydroxy groups include glycerin, trimethylolpropane, and pentaerythritol.

Such polyhydric alcohols may be used alone or in combination.

The amorphous polyester resin has a glass transition temperature (Tg) ranging preferably from 50° C. to 80° C., and more preferably from 50° C. to 65° C.

The glass transition temperature is determined from a DSC curve obtained by differential scanning calorimetry (DSC) and can be specifically determined in accordance with "Extrapolated Starting Temperature of Glass Transition" described in determination of glass transition temperature in JIS K 7121-1987 "Testing Methods for Transition Temperatures of Plastics".

The amorphous polyester resin has a weight average molecular weight (Mw) ranging preferably from 5000 to 1000000, and more preferably from 7000 to 500000.

The amorphous polyester resin suitably has a number average molecular weight (Mn) ranging from 2000 to 100000.

The amorphous polyester resin has a molecular weight distribution Mw/Mn ranging preferably from 1.5 to 100, and more preferably from 2 to 60.

The weight average molecular weight and number average molecular weight are measured by gel permeation chromatography (GPC). The measurement of the molecular weight by GPC involves using a measurement apparatus that is GPC•HLC-8120GPC manufactured by Tosoh Corporation, a column that is TSK gel Super HM-M (15 cm) manufactured by Tosoh Corporation, and a tetrahydrofuran (THF) solvent. From results of such measurement, the weight average molecular weight and the number average molecular weight are calculated from a molecular weight calibration curve plotted on the basis of a standard sample of monodisperse polystyrene.

The amorphous polyester resin can be produced by any of known techniques. In particular, the amorphous polyester resin is, for example, produced through a reaction at a polymerization temperature ranging from 180° C. to 230° C. optionally under reduced pressure in the reaction system, while water or alcohol that is generated in condensation is removed.

In the case where monomers as the raw materials are not dissolved or compatible at the reaction temperature, a solvent having a high boiling point may be used as a solubilizing agent in order to dissolve the raw materials. In such a case, the polycondensation reaction is performed while the solubilizing agent is distilled away. In the case where monomers having low compatibility are used in the copolymerization reaction, such monomers are preliminarily subjected to condensation with an acid or alcohol that is to undergo polycondensation with the monomers, and then the resulting product is subjected to polycondensation with the principle components.

Crystalline Polyester Resin

Examples of the crystalline polyester resin include polycondensates of a polycarboxylic acid with a polyhydric alcohol. The crystalline polyester resin may be a commercially available product or a synthesized resin.

The crystalline polyester resin may be suitably a polycondensate prepared from polymerizable monomers having linear aliphatics rather than a polycondensate prepared from polymerizable monomers having aromatics in terms of easy formation of a crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid); aromatic dicarboxylic acids (e.g., dibasic acids such as phthalic acid, isophthalic acid, terephthalic acid, and naphthalene-2,6-dicarboxylic acid); anhydrides of these dicarboxylic acids; and lower alkyl esters (having, for example, from 1 to 5 carbon atoms) of these dicarboxylic acids.

The polycarboxylic acid may be a combination of the dicarboxylic acid with a carboxylic acid that has three or more carboxy groups and that gives a cross-linked structure or a branched structure. Examples of the carboxylic acid having three carboxy groups include aromatic carboxylic acids (such as 1,2,3-benzenetricarboxylic acid, 1,2,4-benzenetricarboxylic acid, and 1,2,4-naphthalenetricarboxylic acid); anhydrides of these tricarboxylic acids; and lower alkyl esters (having, for example, from 1 to 5 carbon atoms) of these tricarboxylic acids.

The polycarboxylic acid may be a combination of these dicarboxylic acids with a dicarboxylic acid having a sulfonic group or a dicarboxylic acid having an ethylenic double bond.

The polycarboxylic acids may be used alone or in combination.

Examples of the polyhydric alcohol include aliphatic diols (such as linear aliphatic diols having a backbone with from 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol are suitable.

The polyhydric alcohol may be a combination of the diol with an alcohol that has three or more hydroxy groups and that gives a cross-linked structure or a branched structure. Examples of the alcohol having three or more hydroxy groups include glycerin, trimethylolethane, trimethylolpropane, and pentaerythritol.

The polyhydric alcohols may be used alone or in combination.

The aliphatic diol content in the polyhydric alcohol may be 80 mol % or more, and suitably 90 mol % or more.

The melting temperature of the crystalline polyester resin is preferably from 50° C. to 100° C., more preferably from 55° C. to 90° C., and further preferably from 60° C. to 85° C.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

The weight average molecular weight (Mw) of the crystalline polyester resin is suitably from 6,000 to 35,000.

The crystalline polyester resin can be, for example, produced by any of known techniques as in preparation of the amorphous polyester resin.

The amount of the binder resin is, for instance, preferably from 40 mass % to 95 mass %, more preferably from 50 mass % to 90 mass %, and further preferably from 60 mass % to 85 relative to the whole toner particles.

The amount of the crystalline resin is preferably from 3 mass % to 20 mass %, and more preferably from 5 mass % to 15 mass % relative to the whole toner particles in order to enhance the fixability of the toner at low temperature.

Colorant

Examples of the colorant include a variety of pigments, such as carbon black, chrome yellow, Hansa Yellow, benzidine yellow, indanthrene yellow, quinoline yellow, pigment yellow, permanent orange GTR, pyrazolone Orange, Vulcan Orange, Watchung Red, Permanent Red, Brilliant Carmine 3B, Brilliant Carmine 6B, Du Pont Oil Red, pyrazolone red, lithol red, rhodamine B lake, lake red C, pigment red, rose bengal, aniline blue, ultramarine blue, chalco oil blue, methylene blue chloride, phthalocyanine blue, pigment blue, phthalocyanine green, and malachite green oxalate, and a variety of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination.

The colorant may be optionally a surface-treated colorant or may be used in combination with a dispersant. Different types of colorant may be used in combination.

The amount of the colorant is, for instance, preferably from 1 mass % to 30 mass %, and more preferably from 3 mass % to 15 mass % relative to the amount of the whole toner particles.

Other Additives

Examples of other additives include known additives such as a magnetic material, a charge-controlling agent, and inorganic powder. These additives are contained in the toner particles as internal additives.

Characteristics of Toner Particles

The toner particles may have a monolayer structure or may have a core shell structure including a core (core particle) and a coating layer (shell layer) that covers the core.

The toner particles having a core shell structure, for instance, properly include a core containing the binder resin and optionally an additive, such as a colorant or a release agent, and a coating layer containing the binder resin.

The volume average particle size (D50v) of the toner particles is preferably from 2 μm to 10 μm, and more preferably from 4 μm to 8 μm.

The average particle size of the toner particles and the index of the particle size distribution thereof are measured with COULTER MULTISIZER II (manufactured by Beckman Coulter, Inc.) and an electrolyte that is ISOTON-II (manufactured by Beckman Coulter, Inc.).

In the measurement, from 0.5 mg to 50 mg of a test sample is added to 2 ml of an aqueous solution of a 5% surfactant (suitably sodium alkylbenzene sulfonate) as a dispersant. This product is added to from 100 ml to 150 ml of the electrolyte.

The electrolyte suspended with the sample is subjected to dispersion for 1 minute with an ultrasonic disperser and then subjected to the measurement of the particle size distribution of particles having a particle size ranging from 2 μm to 60 μm using COULTER MULTISIZER II with an aperture having an aperture diameter of 100 μm. The number of sampled particles is 50,000.

Cumulative distributions by volume and by number are drawn from the smaller diameter side in particle size ranges (channels) into which the measured particle size distribution is divided. The particle size for a cumulative percentage of 16% is defined as a volume particle size D16v and a number particle size D16p, while the particle size for a cumulative percentage of 50% is defined as a volume average particle size D50v and a number average particle size D50p. Furthermore, the particle size for a cumulative percentage of 84% is defined as a volume particle size D84v and a number particle size D84p.

From these particle sizes, the index of the volume particle size distribution (GSDv) is calculated as $(D84v/D16v)^{1/2}$, while the index of the number particle size distribution (GSDp) is calculated as $(D84p/D16p)^{1/2}$.

The shape factor SF1 of the toner particles is suitably 140 or more, preferably from 140 to 155, more preferably from 143 to 153, and further preferably from 145 to 151.

In the case where the toner particles are produced by a pulverizing method such as a kneading pulverizing method, the shape of the toner particles is amorphous, and the shape factor SF1 is, for instance, 140 or more. In the toner particles having a shape factor SF1 of 140 or more, the release agent is likely to be exposed on the surface thereof owing to the production method. The release agent exposed on the surface is easily evaporated by the heat in the fixing of the toner, which readily results in the generation of the UFPs. Even in this case, however, the amount of the UFPs discharged to the outside of the image forming apparatus is reduced according to the exemplary embodiment.

The shape factor SF1 is given from the following equation.

$$SF1=(ML^2/A)\times(\pi/4)\times 100 \quad \text{Equation:}$$

In this equation, ML represents the absolute maximum length of toner, and A represents the projected area of toner.

Specifically, the shape factor SF1 is converted into numerals principally by analyzing a microscopic image or a scanning electron microscopic (SEM) image with an image analyzer and calculated as follows. In particular, the optical microscopic image of particles scattered on the surface of a glass slide is input to an image analyzer LUZEX through a video camera to measure the maximum lengths and projected areas of 100 particles, the SF1 is calculated for them from the above equation, and the average thereof is obtained.

The toluene insoluble content in the toner particles is preferably from 25 mass % to 40 mass %, more preferably from 28 mass % to 38 mass %, and further preferably from 30 mass % to 35 mass %.

The toluene insoluble content in the toner particles in such a range enables the release agent to be confined in the toner particles, which reduces the exposure of the release agent on the surface of the toner particles. Thus, the generation of the UFPs derived from the release agent is reduced.

The toluene-insoluble component of the toner particles refers to the component that is contained in the toner particles but not dissolved in toluene. In other words, the toluene-insoluble component is an insoluble matter of which the principle component (for instance, 50 mass % or more of the whole) is a component of the binder resin that is not dissolved in toluene (particularly high-molecular-weight component of binder resin). The amount of the toluene-insoluble component can be an index of the cross-linked resin content in the toner.

The amount of the toluene-insoluble component is measured as follows.

Toner particles (or toner) weighed to 1 g are put into weighed cylindrical filter paper made of glass fibers, and this cylindrical filter paper is attached to the extraction tube of a thermal Soxhlet extractor. Toluene is put into a flask and heated to 110° C. with a mantle heater. A heater attached to the extraction tube is used to heat the surrounding of the extraction tube to 125° C. The extraction is performed at such a reflux rate that a single cycle of extraction is in the range of four minutes to five minutes. After the extraction is performed for 10 hours, the cylindrical paper filter and residual toner are retrieved, dried, and weighed.

Then, the amount (mass %) of the toner particle residue (or toner residue) is calculated on the basis of the following equation and defined as the amount of the toluene-insoluble component (mass %).

amount (mass %) of toner particle residue (or toner residue)=[(weight of cylindrical filter paper+weight of residual toner) (g)−weight of cylindrical filter paper (g)]+mass (g) of toner particles (or toner)×100 Equation:

The toner particle residue (or toner residue) contains, for example, a colorant, an inorganic substance such as an external additive, and the high-molecular-weight component of the binder resin. In the case where the toner particles contain a release agent, the release agent is a toluene-soluble component because the extraction is carried out through heating.

The toluene-insoluble component of the toner particles is, for example, adjusted by (1) adding a cross-linking agent to a high-molecular-weight component having a reactive functional group at its end to form a cross-linked structure or a branched structure in the binder resin, (2) using a polyvalent metal ion in the binder resin to form a cross-linked structure or a branched structure in a high-molecular-weight component having an ionic functional group at its end, or (3) using, for instance, isocyanate in the binder resin to extend the chain structure of the resin or to allow it to branch.

External Additives

Examples of external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$ $Al_2O_3.2SiO_2$, $CaCO_3$, $MgCO_3$, $BaSO_4$, and $MgSO_4$.

The surfaces of the inorganic particles as an external additive may be hydrophobized. The hydrophobization is performed by, for example, immersing the inorganic particles in a hydrophobizing agent. The hydrophobizing agent is not particularly limited; and examples thereof include silane coupling agents, silicone oils, titanate coupling agents, and aluminum coupling agents. These may be used alone or in combination The amount of the hydrophobizing agent is, for instance, generally from 1 part by mass to 10 parts by mass relative to 100 parts by mass of the inorganic particles.

Examples of the external additives also include resin particles [resin particles such as polystyrene particles, polymethyl methacrylate (PMMA) particles, and melamine resin particles] and cleaning aids (for instance, metal salts of higher fatty acids, such as zinc stearate, and particles of a high-molecular-weight fluorine material).

The amount of the external additive to be used is, for example, preferably from 0.01 mass % to 5 mass %, and more preferably from 0.01 mass % to 2.0 mass % relative to the amount of the toner particles.

Preparation of Toner

Preparation of the toner used in the exemplary embodiment will now be described.

The toner used in the exemplary embodiment can be produced by preparing toner particles and then externally adding an external additive to the toner particles.

The toner particles may be produced by any of a dry process (such as a kneading pulverizing method) and a wet process (such as an aggregation coalescence method, a suspension polymerization method, or a dissolution suspension method). Preparation of the toner particles is not particularly limited to these preparation processes, and any of known techniques can be employed.

In particular, the toner particles are suitably produced by an aggregation coalescence method.

Aggregation Coalescence Method

Specifically, for example, preparation of the toner particles by an aggregation coalescence method include the following processes:

preparing a dispersion liquid of resin particles in which resin particles as the binder resin have been dispersed (preparation of dispersion liquid of resin particles), aggregating the resin particles (optionally with other particles) in the dispersion liquid of resin particles (dispersion liquid optionally mixed with a dispersion liquid of other particles) to form an aggregated particles (formation of aggregated particles), and heating a dispersion liquid of aggregated particles in which the aggregated particles have been dispersed to fuse and coalesce the aggregated particles into toner particles (fusion and coalescence).

Each of the processes will now be described in detail.

In the following description, a method for producing the toner particles containing a colorant and a release agent will be explained; however, use of the colorant and the release agent is optional. Additives other than the colorant and the release agent may be obviously used. Preparation of Dispersion Liquid of Resin Particles The dispersion liquid of resin particles in which resin particles as a binder resin have been dispersed as well as, for example, a dispersion liquid of colorant particles in which colorant particles have been dispersed and a dispersion liquid of release agent particles in which release agent particles have been dispersed are prepared.

The dispersion liquid of the resin particles is, for example, prepared by dispersing the resin particles in a dispersion medium with a surfactant.

Examples of the dispersion medium used in the dispersion liquid of resin particles include aqueous media.

Examples of the aqueous media include water, such as distilled water and ion exchanged water, and alcohols. These aqueous media may be used alone or in combination.

Examples of the surfactant include anionic surfactants such as sulfuric acid ester salts, sulfonic acid salts, phosphoric acid esters, and soaps; cationic surfactants such as amine salts and quaternary ammonium salts; and nonionic surfactants such as polyethylene glycol, alkylphenol-ethylene oxide adducts and polyols. Among these surfactants, anionic surfactants and cationic surfactants may be used. Nonionic surfactants may be used in combination with anionic surfactants or cationic surfactants.

The surfactants may be used alone or in combination.

In the dispersion liquid of resin particles, the resin particles can be dispersed in the dispersion medium by any of known dispersion techniques; for example, general dispersers can be used, such as rotary shearing homogenizers or those having media, e.g., a ball mill, a sand mill, and a DYNO mill. Depending on the type of resin particles, the resin particles may be, for instance, dispersed in the dispersion liquid of resin particles by phase inversion emulsification.

In the phase inversion emulsification, a resin to be dispersed is dissolved in a hydrophobic organic solvent in which the resin can be dissolved, a base is added to an organic continuous phase (O phase) for neutralization, and then an aqueous medium (W phase) is added thereto to turn the phase to a discontinuous phase by the conversion of the resin (namely, phase inversion) from W/O to O/W, thereby dispersing the resin in the aqueous medium in the form of particles.

The volume average particle size of the resin particles to be dispersed in the dispersion liquid of resin particles is, for example, preferably from 0.01 μm to 1 μm, more preferably from 0.08 μm to 0.8 μm, and further preferably from 0.1 μm to 0.6 μm.

The volume average particle size of the resin particles is determined as follows. Particle size distribution is measured with a laser-diffraction particle size distribution analyzer (such as LA-700 manufactured by HORIBA, Ltd.), cumulative distribution by volume is drawn from the smaller particle size side in particle size ranges (channels) into which the measured particle size distribution is divided, and the particle size having a cumulative percentage of 50% relative to the whole particles is determined as the volume average particle size D50v. The volume average particle size of the particles in other dispersion liquids is similarly determined.

The amount of the resin particles contained in the dispersion liquid of resin particles is, for example, preferably from 5 mass % to 50 mass %, and more preferably from 10 mass % to 40 mass %.

The dispersion liquid of colorant particles and the dispersion liquid of release agent particles are, for instance, prepared in the same manner as the preparation of the dispersion liquid of resin particles. Accordingly, the volume average particle size of the particles, the dispersion medium, the dispersion method, and the amount of the particles in the dispersion liquid of resin particles are the same as those of the colorant particles dispersed in the dispersion liquid of colorant particles and the release agent particles dispersed in the dispersion liquid of release agent particles.

Formation of Aggregated Particles

The dispersion liquid of resin particles is mixed with the dispersion liquid of colorant particles and the dispersion liquid of release agent particles.

The resin particles, the colorant particles, and the release agent particles are hetero-aggregated in the mixed dispersion liquid to form aggregated particles having a diameter close to the intended diameter of the toner particles and containing the resin particles, the colorant particles, and the release agent particles.

Specifically, for example, an aggregating agent is added to the mixed dispersion liquid, and the pH of the mixed dispersion liquid is adjusted to be acidic (e.g., pH from 2 to 5). Then, a dispersion stabilizer is optionally added thereto, the resulting mixture is heated to a temperature corresponding to the glass transition temperature of the resin particles (in particular, for example, −30° C. or more and −10° C. or less of the glass transition temperature of the resin particles), and the particles dispersed in the mixed dispersion liquid are aggregated, thereby forming the aggregated particles.

In the formation of the aggregated particles, for instance, the aggregating agent may be added to the mixed dispersion liquid at room temperature (for instance, 25° C.) under stirring with a rotary shearing homogenizer, the pH of the mixed dispersion liquid may be adjusted to be acidic (e.g., pH from 2 to 5), a dispersion stabilizer may be optionally added thereto, and the resulting mixture may be heated.

Examples of the aggregating agent include surfactants having an opposite polarity to the surfactant used as a dispersant that is to be added to the mixed dispersion liquid, such as inorganic metal salts and di- or higher valent metal complexes. In the case where a metal complex is used as the aggregating agent, the surfactant can be used in a reduced amount, and charging properties can be improved.

An additive that forms a complex or a similar bond with the metal ions of the aggregating agent may be optionally used. Such an additive is suitably a chelating agent.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of the chelating agent include oxycarboxylic acids such as tartaric acid, citric acid, and gluconic acid; iminodiacetic acid (IDA); nitrilotriacetic acid (NTA); and ethylenediaminetetraacetic acid (EDTA).

The amount of the chelating agent is, for example, preferably from 0.01 part by mass to 5.0 parts by mass, more preferably 0.1 part by mass or more and less than 3.0 parts by mass relative to 100 parts by mass of the resin particles.

Fusion and Coalescence

The dispersion liquid of aggregated particles in which the aggregated particles have been dispersed is, for example, heated to the glass transition temperatures or more of the resin particles (such as from 10° C. to 30° C. higher than the glass transition temperatures of the resin particles) to fuse and coalesce the aggregated particles, thereby forming the toner particles.

Through the above-mentioned processes, the toner particles are produced.

The method for forming the toner particles may have the following additional processes: after the dispersion liquid of aggregated particles in which the aggregated particles have been dispersed is obtained, the dispersion liquid of aggregated particles is further mixed with a dispersion liquid of resin particles in which the resin particles have been dispersed, and the particles are aggregated such that the resin particles further adhere to the surfaces of the aggregated particles to produce second aggregated particles; and a dispersion liquid of second aggregated particles in which the second aggregated particles have been dispersed is heated to fuse and coalesce the second aggregated particles, thereby producing toner particles having a core shell structure.

After the fusion and coalescence, the toner particles formed in the solution are washed, subjected to solid-liquid separation, and dried by known techniques to yield dried toner particles.

The washing may be sufficiently carried out by displacement washing with ion exchanged water in terms of charging properties. The solid-liquid separation is not particularly limited but may be suction filtration or pressure filtration in terms of productivity. The drying is not particularly limited but may be freeze drying, flush drying, fluidized drying, or vibratory fluidized drying in terms of productivity.

An external additive is, for instance, added to the produced toner particles that are in a dried state, and the resulting toner particles are mixed to produce the toner used in the exemplary embodiments. The mixing may be performed, for example, with a V-blender, a HENSCHEL MIXER, or a LOEDIGE MIXER. The coarse particles of the toner may be optionally removed with a vibrating sieve, an air sieve, or another device.

Kneading Pulverizing Method

The toner particles used in the exemplary embodiment may be produced by a pulverizing method such as a kneading pulverizing method. In the case where the toner particles are produced by a pulverizing method, the shape of the toner particles is amorphous, and the shape factor SF1 is, for example, in the above-mentioned range. The release agent is likely to be exposed on the surface of the toner particles owing to the preparation method, which readily results in the generation of the UFPs. Even in this case, however, the amount of the UFPs discharged to the outside of the apparatus is reduced according to the exemplary embodiment.

The toner particles are produced by a kneading pulverizing method through melt-kneading, pulverizing, and classifying the binder resin and a release agent at least containing a specific paraffin wax having a melting temperature being in the above-mentioned range. The preparation of the toner particles by the kneading pulverizing method, for instance, includes a kneading process of melt-kneading materials including the binder resin and the release agent, a cooling process of cooling the melt-kneaded product, a pulverizing process of pulverizing the melt-kneaded product after the cooling process, and a classifying process of classifying the pulverized product.

Each of the processes of the kneading pulverizing method will now be described in detail.

Kneading Process

In the kneading process, materials including the binder resin and the release agent (materials for producing resin particles) are melt-kneaded to produce a kneaded product.

Examples of a kneader used in the kneading process include a three-roll kneader, a uniaxial screw kneader, a biaxial screw kneader, and a Banbury mixer.

The melting temperature may be determined on the basis of the types of binder resin and release agent to be kneaded and the content proportion thereof.

Cooling Process

In the cooling process, the kneaded product obtained in the kneading process is cooled.

In the cooling process, the temperature of the kneaded product is suitably decreased from the temperature of the kneaded product at the completion of the kneading process to 40° C. at an average temperature decrease rate of 4° C./s or more in order to maintain the dispersion state immediately after the kneading process.

The term "average temperature decrease rate" refers to the average of the rate taken to decrease the temperature of the kneaded product at the completion of the kneading process up to 40° C.

In the cooling process, the cooling is, for example, performed with a rolling roller, in which cold water or brine circulates, or a pinching type cooling belt. In the cooling in this manner, the cooling rate is determined, for instance, on the basis of the speed of the rolling roller, the flow rate of the brine, the amount of the kneaded product to be supplied, or a slab thickness during the rolling of the kneaded product. The slab thickness is suitable from 1 mm to 3 mm.

Pulverizing Process

The kneaded product cooled in the cooling process is pulverized in a pulverizing process to form particles.

In the pulverizing process, for example, a mechanical pulverizer, a jet pulverizer, or another pulverizer is used.

Classifying Process

The pulverized product (particles) obtained in the pulverizing process may be optionally classified in the classifying process.

In the classifying process, a typical centrifugal classifier, inertial classifier, or another classifier is used to remove fine powder (particles having a particle size smaller than the intended size) and coarse powder (particles having a particle size larger than the intended size).

An external additive is, for instance, added to the produced toner particles that are in a dried state, and the resulting toner particles are mixed to produce the toner used in the exemplary embodiments. The mixing may be performed, for example, with a V-blender, a HENSCHEL MIXER, or a LOEDIGE MIXER. The coarse particles of the toner may be optionally removed with a vibrating sieve, an air sieve, or another device.

Developer

The developer used in the exemplary embodiment at least contains the toner used in the exemplary embodiment.

The developer used in the exemplary embodiment may be a single component developer containing only the toner used in the exemplary embodiment or may be a two component toner that is a mixture of the toner and a carrier.

The carrier is not particularly limited, and any of known carriers can be used. Examples of the carrier include coated carriers in which the surface of a core formed of magnetic powder has been coated with a coating resin, magnetic powder dispersed carriers in which magnetic powder has been dispersed in or blended with a matrix resin, and resin impregnated carriers in which porous magnetic powder has been impregnated with resin.

In the magnetic powder dispersed carriers and the resin impregnated carriers, the constituent particles may have a surface coated with a coating resin.

Examples of the magnetic powder include magnetic metals, such as iron, nickel, and cobalt, and magnetic oxides such as ferrite and magnetite.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluororesins, polyester, polycarbonate, phenol resins, and epoxy resins.

The coating resin and the matrix resin may contain other additives such as conductive particles.

Examples of the conductive particles include particles of metals such as gold, silver, and copper; carbon black particles; titanium oxide particles; zinc oxide particles; tin oxide particles; barium sulfate particles; aluminum borate particles; and potassium titanate particles.

An example of the preparation of the coated carrier involves coating with a coating layer forming solution in which the coating resin and optionally a variety of additives have been dissolved in a proper solvent. The solvent is not particularly limited and may be determined in view of, for instance, the type of coating resin to be used and coating suitability.

Specific examples of the coating method include a dipping method of dipping the core into the coating layer forming solution, a spray method of spraying the coating layer forming solution onto the surface of the core, a fluid-bed method of spraying the coating layer forming solution to the core that is in a state of being floated by the flowing air, and a kneader coating method of mixing the core of the carrier with the coating layer forming solution in the kneader coater and removing a solvent.

The mixing ratio (mass ratio) of the toner to the carrier in the two-component developer (toner:carrier) is preferably from 1:100 to 30:100, and more preferably from 3:100 to 20:100.

Examples

The present disclosure will now be further specifically described in detail with reference to Examples and Comparative Examples but is not limited thereto at all.

Preparation of Crystalline Resin (A)

Into a three-neck flask, 100 parts by mass of dimethyl sebacate, 67.8 parts by mass of hexanediol, and 0.10 parts by mass of dibutyltin oxide are put. The mixture is reacted at 185° C. for 5 hours under nitrogen atmosphere while water generated in the reaction is removed to the outside. Then, the temperature is increased up to 220° C. while the pressure is gradually reduced, and the resulting product is further reacted for 6 hours and then cooled. Through this process, a crystalline resin (A) having a weight average molecular weight of 33,700 is prepared.

Preparation of Amorphous Resin

Preparation of Amorphous Resin (1)

Into a three-neck flask, 61 parts by mass of dimethyl terephthalate, 75 parts by mass of dimethyl fumarate, 34 parts by mass of dodecenylsuccinic anhydride, 16 parts by mass of trimellitic acid, 137 parts by mass of ethylene oxide adducts of bisphenol A, 191 parts by mass of propylene oxide adducts of bisphenol A, and 0.3 parts by mass of dibutyltin oxide are put. The mixture is reacted at 180° C. for 3 hours under nitrogen atmosphere while water generated in the reaction is removed to the outside. Then, the temperature is increased up to 280° C. while the pressure is gradually reduced, and the resulting product is reacted for 2 hours and then cooled. Through this process, an amorphous polyester resin (1) having a weight average molecular weight of 19,000 is produced.

Preparation of Amorphous Resin (2)

The amounts of the dimethyl terephthalate, dimethyl fumarate, dodecenylsuccinic anhydride, and trimellitic acid are changed to 60 parts by mass, 74 parts by mass, 30 parts by mass, and 22 parts by mass, respectively; except for that, an amorphous resin (2) is produced as in the preparation of the amorphous resin (1). The weight average molecular weight of the amorphous resin (2) is 19,500.

Preparation of Amorphous Resin (3)

The amounts of the dimethyl terephthalate, dimethyl fumarate, dodecenylsuccinic anhydride, and trimellitic acid are changed to 60 parts by mass, 70 parts by mass, 29 parts by mass, and 29 parts by mass, respectively; except for that, an amorphous resin (3) is produced as in the preparation of the amorphous resin (1). The weight average molecular weight of the amorphous resin (3) is 18,200.

Preparation of Amorphous Resin (4)

The amounts of the dimethyl terephthalate, dimethyl fumarate, dodecenylsuccinic anhydride, and trimellitic acid are changed to 55 parts by mass, 64 parts by mass, 27 parts by mass, and 46 parts by mass, respectively; except for that, an amorphous resin (4) is produced as in the preparation of the amorphous resin (1). The weight average molecular weight of the amorphous resin (4) is 17,200.

Preparation of Toner

Preparation of Toner Particles (1)

Into a HENSCHEL MIXER (manufactured by NIPPON COKE & ENGINEERING CO., LTD.), 79 parts by mass of the amorphous polyester resin (1), 7 parts by mass of a colorant (C.I. Pigment Blue 15:1), 5 parts by mass of a release agent (paraffin wax manufactured by NIPPON SEIRO CO., LTD., melting temperature of 73° C.), and 8 parts by mass of the crystalline resin (A) (melting point: 71° C.) are put. The mixture is stirred and mixed at a rotational speed of 15 m/s for 5 minutes, and the resulting mixture is melt-kneaded with an extruder-type continuous kneader.

In the extruder-type continuous kneader, the temperature is 160° C. on the supply side and 130° C. on the discharge side, the temperature of a cooling roller is 40° C. on the supply side and 25° C. on the discharge side. The temperature of a cooling belt is adjusted to be 10° C.

The melt-kneaded product is cooled, then roughly pulverized with a hammer mill, and subsequently finely pulverized with a jet pulverizer (manufactured by Nippon Pneumatic Mfg. Co., Ltd.) to 6.5 μm. The resulting product is classified with an elbow-jet classifier (type: EJ-LABO, manufactured by Nittetsu Mining Co., Ltd.) to yield toner particles (1) having a volume average particle size of 6.9 μm.

The toner particles (1) have an SF1 of 145 and a toluene-insoluble content of 25 mass %.

Preparation of Toner Particles (2)

Except that the amorphous resin (2) is used in place of the amorphous resin (1), toner particles (2) having a volume average particle size of 6.8 μm are produced as in the preparation of the toner particles (1).

The toner particles (2) have an SF1 of 147 and a toluene-insoluble content of 29 mass %.

Preparation of Toner Particles (3)

Except that the amorphous resin (3) is used in place of the amorphous resin (1), toner particles (3) having a volume average particle size of 7.0 μm are produced as in the preparation of the toner particles (1).

The toner particles (3) have an SF1 of 149 and a toluene-insoluble content of 35 mass %.

Preparation of Toner Particles (4)

Except that the amorphous resin (4) is used in place of the amorphous resin (1), toner particles (4) having a volume average particle size of 7.3 μm are produced as in the preparation of the toner particles (1).

The toner particles (4) have an SF1 of 151 and a toluene-insoluble content of 40 mass %.

Preparation of Toner Particles (5)

Except that a ceresin wax (melting temperature: 92° C.) is used in place of the paraffin wax used as the binder resin in the preparation of the toner particles (1), toner particles (5) having a volume average particle size of 6.8 μm are produced as in the preparation of the toner particles (1).

The toner particles (5) have an SF1 of 148 and a toluene-insoluble content of 33 mass %.

Preparation of Toner Particles (C1)

Except that the paraffin wax used as the binder resin in the preparation of the toner particles (1) is changed to another paraffin wax (POLYWAX 725 manufactured by BAKER PETROLITE, melting temperature: 105° C.), toner particles (C1) having a volume average particle size of 7.0 μm are produced as in the preparation of the toner particles (1).

The toner particles (C1) have an SF1 of 146 and a toluene-insoluble content of 45 mass %.

Preparation of Toners and Developers

With 100 parts by mass of the individual toner particles, 1.2 parts by mass of an external additive that is a commercially available fumed silica RX50 (manufactured by NIPPON AEROSIL CO., LTD.) is mixed using a HENSHEL MIXER (manufactured by MITSUI MIIKE MACHINERY Co., Ltd.) at a rotational speed of 30 m/s for 5 minutes, thereby obtaining toners (1) to (5) and (C1), respectively.

With 100 parts by mass of a carrier, 8 parts by mass of the individual toners are separately mixed to produce developers (1) to (5) and (C1), respectively.

In order to produce the carrier, 14 parts by mass of toluene and 2 parts by mass of a styrene-methyl methacrylate copolymer (component ratio: styrene/methyl methacrylate=90/10, weight average molecular weight Mw: 80,000) are stirred for 10 minutes with a stirrer to prepare a coating liquid in which these materials have been dispersed. The coating liquid and 100 parts by mass of ferrite particles (volume average particle size: 50 μm) are put into a vacuum degassing kneader (manufactured by INOUE MFG., INC.) and stirred at 60° C. for 30 minutes. Then, the pressure is reduced for degassing under heating to dry the resulting product, and the dried product is filtered with a 105-μm sieve to yield the carrier.

Examples A1 to A5

An image forming apparatus (trade name: 700 DIGITAL COLOR PRESS, manufactured by Fuji Xerox Co., Ltd.) is modified into an image forming apparatus that includes a fixing device having a similar structure to the fixing device illustrated in FIG. 2 (also referred to as "fixing device A"), a charger, and a particle collecting device.

Specifically, the image forming apparatus is modified so as to have the charger and particle collecting device that are disposed in the vicinity of the nipping region, which is formed between the heating roller and the pressure belt, and upstream of the nipping region in the transport direction of a recording medium as illustrated in FIG. 2. In addition, a filter attached to an exhaust outlet of the image forming apparatus is removed.

In the modified image forming apparatus, the minimum distance from the upstream end of the nipping region in the transport direction to the charger is 35 mm, and the minimum distance from the transport path of paper to the charger is in the range of 10 mm to 40 mm. The minimum distance between the charger and the particle collecting device is 10 mm.

The preset fixing temperature of the heating roller is 155° C.

The charger is a single long corona discharge device (modified product of a corona discharge device manufactured by Keyence Corporation), and a charging condition is an applied voltage of −5 kV. The particle collecting device is a single long electrode (modified product of an electrode manufactured by TOKAI CARBON CO., LTD.), and a charging condition is an applied voltage of +5 kV.

The developers shown in Table 1 are individually put into the developing device of the image forming apparatus.

Examples B1 to B5

An image forming apparatus (trade name: 700 DIGITAL COLOR PRESS, manufactured by Fuji Xerox Co., Ltd.) is modified into an image forming apparatus that includes a fixing device having a similar structure to the fixing device illustrated in FIG. 3 (also referred to as "fixing device B"), a charger, and a particle collecting device.

Specifically, the charger and particle collecting device are disposed in the vicinity of the nipping region, which is formed between the heating belt and the pressure roller, and upstream of the nipping region in the transport direction of a recording medium as illustrated in FIG. 3. In addition, a filter attached to an exhaust outlet of the image forming apparatus is removed.

In the modified image forming apparatus, the minimum distance from the upstream end of the nipping region in the transport direction to the charger is 35 mm, and the minimum distance from the transport path of paper to the charger is in the range of 10 mm to 40 mm. The minimum distance between the charger and the particle collecting device is 10 mm.

The preset fixing temperature of the heating belt is 155° C.

The charger is a single long corona discharge device (modified product of a corona discharge device manufactured by Keyence Corporation), and a charging condition is an applied voltage of −5 kV. The particle collecting device is a single long electrode having an arc-like cross-sectional shape (modified product of an electrode manufactured by TOKAI CARBON CO., LTD.), and a charging condition is an applied voltage of +5 kV.

The developers shown in Table 1 are individually put into the developing device of the image forming apparatus.

Comparative Examples 1 and 2 and Reference Example

The charger and the particle collecting device are removed from the image forming apparatus of Example A1 to prepare an image forming apparatus of Comparative Example 1.

The charger and the particle collecting device are removed from the image forming apparatus of Example B1 to prepare an image forming apparatus of Comparative Example 2.

The charger and the particle collecting device are removed from the image forming apparatus of Example A1, and a developer containing the toner particles (C1) is put into the developing device, thereby preparing an image forming apparatus of Reference Example. The preset fixing temperature of the heating roller is as shown in Table 1.

Evaluations

Evaluation of Fixability at Low Temperature

A patch of an unfixed image which has a size of 4 cm×5 cm and in which the toner is to be used in an amount of 4.0 g/m$^2$ is formed on J paper (A4 size). This patch is printed at a fixed processing speed of 140 mm/s, and the printed image is fixed with fixing temperature being changed from 80° C. to 180° C. by 5° C. The lowest fixing temperature at which offset does not occur (lowest fixing temperature) is determined and evaluated on the basis of the following criteria.

The evaluation criteria are as follows.

A: Lowest fixing temperature of less than 120° C.

B: Lowest fixing temperature of 120° C. or more and less than 130° C.

C: Lowest fixing temperature of 130° C. or more and less than 140° C.

D: Lowest fixing temperature of 140° C. or more Evaluation of UFPs

An image having an image density of 100% is continuously formed on both sides of 1000 sheets of A3-size paper at a temperature of 22° C. and relative humidity (RH) of 55%. The particle emission rate ($PER_{10\ PW}$) of the UFPs discharged from the image forming apparatus during the formation of the image is measured at Test Laboratory of Fuji Xerox Co., Ltd. in accordance with RAL UZ-171.

The value of the measured particle emission rate [unit (number of particles/10 min)] is evaluated and graded from G1 to G3. The particle emission rates in Comparative Examples in which the fixing device without a collection member is used are graded G3 and serve as the standard to perform relative evaluation. The particle emission rate is smallest in G1, which means that the amount of the UFPs is small.

TABLE 1

| | Developer | | Fixing device | | | | | Evaluations | |
|---|---|---|---|---|---|---|---|---|---|
| | Type of toner particles No. | Melting temperature of release agent T2 [° C.] | Type | Preset fixing temperature of heating roller or heating belt T1 [° C.] | Charger | Particle collecting device | T1-T2 [° C.] | Fixability at low temperature | Amount of discharged UFPs |
| Example A1 | (1) | 73 | A | 155 | Corona discharge | Electrode | 82 | A | G2 |
| Example A2 | (2) | 73 | A | 155 | Corona discharge | Electrode | 82 | A | G2 |
| Example A3 | (3) | 73 | A | 155 | Corona discharge | Electrode | 82 | A | G2 |
| Example A4 | (4) | 73 | A | 155 | Corona discharge | Electrode | 82 | A | G2 |
| Example A5 | (5) | 92 | A | 155 | Corona discharge | Electrode | 63 | B | G1 |
| Example B1 | (1) | 73 | B | 155 | Corona discharge | Electrode | 82 | A | G1 |
| Example B2 | (2) | 73 | B | 155 | Corona discharge | Electrode | 82 | A | G1 |
| Example B3 | (3) | 73 | B | 155 | Corona discharge | Electrode | 82 | A | G1 |
| Example B4 | (4) | 73 | B | 155 | Corona discharge | Electrode | 82 | A | G1 |
| Example B5 | (5) | 92 | B | 155 | Corona discharge | Electrode | 63 | B | G1 |
| Comparative Example 1 | (1) | 73 | A | 155 | — | — | 82 | A | G3 |
| Comparative Example 2 | (1) | 73 | B | 155 | — | — | 82 | A | G3 |
| Reference Example | (C1) | 105 | A | 200 | — | — | 95 | D | G1 |

From the results shown in the table, the amount of the discharged UFPs derived from the release agent used in the toner is reduced more in Examples than in Comparative Examples.

Since the melting temperature of the release agent used in the toner is greater than 100° C. in Reference Example, the amount of discharged UFPs derived from the release agent used in the toner is small.

Since the lowest fixing temperature is higher in Reference Example than in Examples and Comparative Examples, the fixability at low temperature is poor in Reference Example.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding member;

a charging unit that charges a surface of the image holding member;

an electrostatic latent image forming unit that forms an electrostatic latent image on the charged surface of the image holding member;

a developing unit that includes a developer containing toner particles containing a release agent having a melting temperature ranging from 60° C. to 100° C. and that develops the electrostatic latent image on the surface of the image holding member with the developer to form a toner image;

a transferring unit that transfers the toner image to a recording medium;

a fixing unit that includes two members of which outer surfaces are in contact with each other to form a nipping region and of which at least one member is a belt member and that allows the recording medium having the transferred toner image to pass through the nipping region to fix the toner image to the recording medium;

a particle charging unit that is disposed in the vicinity of the nipping region and upstream of the nipping region in a transport direction of the recording medium so as to face a toner-image-formed side of the recording medium and that charges particles; and a particle collecting unit that is disposed near the particle charging unit and that is charged to an opposite polarity to the charged particles.

2. The image forming apparatus according to claim 1, wherein the melting temperature of the release agent used in the toner particles is in the range of 60° C. to 90° C.

3. The image forming apparatus according to claim 1, wherein the release agent used in the toner particles is a paraffin wax.

4. The image forming apparatus according to claim 1, wherein the toner particles contain a crystalline resin.

5. The image forming apparatus according to claim 4, wherein an amount of the crystalline resin is in the range of 3 mass % to 20 mass % relative to a mass of the toner particles.

6. The image forming apparatus according to claim 4, wherein an amount of the crystalline resin is in the range of 5 mass % to 15 mass % relative to a mass of the toner particles.

7. The image forming apparatus according to claim 1, wherein the toner particles have a toluene-insoluble content ranging from 25 mass % to 40 mass %.

8. The image forming apparatus according to claim 1, wherein the toner particles have a shape factor SF1 of 140 or more.

9. The image forming apparatus according to claim 1, wherein any one of the two members has a preset fixing temperature ranging from 100° C. to 200° C.

10. The image forming apparatus according to claim 9, wherein the preset fixing temperature is in the range of 120° C. to 200° C.

11. The image forming apparatus according to claim 9, wherein any one of the two members is a roller having a heating unit within.

12. The image forming apparatus according to claim 1, wherein between a preset fixing temperature T1 of any one of the two members and a melting temperature T2 of the release agent used in the toner particles a difference (T1−T2) is in the range of 30° C. to 140° C.

13. The image forming apparatus according to claim 1, wherein a distance between the particle charging unit and an upstream end of the nipping region in the transport direction of the recording medium is in the range of 30 mm to 70 mm.

14. The image forming apparatus according to claim 1, wherein a minimum distance between the particle charging unit and the transport path of the recording medium is in the range of 10 mm to 40 mm.

* * * * *